US012270097B2

(12) United States Patent
Huang et al.

(10) Patent No.: US 12,270,097 B2
(45) Date of Patent: Apr. 8, 2025

(54) PREPARATION METHOD OF NICKEL-BASED WROUGHT SUPERALLOY WHEEL DISK FORGINGS USED AT HIGH TEMPERATURE

(71) Applicant: Gaona Aero Material Co., Ltd., Beijing (CN)

(72) Inventors: Shuo Huang, Beijing (CN); Beijiang Zhang, Beijing (CN); Wenyun Zhang, Beijing (CN); Heyong Qin, Beijing (CN); Ran Duan, Beijing (CN); Guangpu Zhao, Beijing (CN); Guohua Xu, Beijing (CN); Shifu Chen, Beijing (CN); Qiang Tian, Beijing (CN)

(73) Assignee: Gaona Aero Material Co., Ltd., Beijing (CN)

( * ) Notice: Subject to any disclaimer, the term of this patent is extended or adjusted under 35 U.S.C. 154(b) by 638 days.

(21) Appl. No.: 17/564,265

(22) Filed: Dec. 29, 2021

(65) Prior Publication Data

US 2022/0119931 A1 Apr. 21, 2022

Related U.S. Application Data

(63) Continuation of application No. PCT/CN2020/098920, filed on Jun. 29, 2020.

(30) Foreign Application Priority Data

Mar. 2, 2020 (CN) ..... 202010137240.1

(51) Int. Cl.
*C22F 1/10* (2006.01)
*B22D 7/00* (2006.01)
(Continued)

(52) U.S. Cl.
CPC ..... *C22F 1/10* (2013.01); *B22D 7/005* (2013.01); *C22C 1/023* (2013.01); *C22C 19/056* (2013.01); *C22C 19/057* (2013.01)

(58) Field of Classification Search
CPC ..... C22C 1/023; C22C 19/056; C22C 19/057; C22C 30/00; C22C 1/06; C22C 1/03;
(Continued)

(56) References Cited

U.S. PATENT DOCUMENTS

2015/0368774 A1* 12/2015 Ota ..... F01D 5/28 148/419

FOREIGN PATENT DOCUMENTS

CN 105112728 A 12/2015
CN 108315599 A 7/2018
(Continued)

OTHER PUBLICATIONS

Pei, et al. "Effect of magnesium and cerium microelement on microstructures and mechanical properties of K465 nickel-base superalloy." 2007. Journal of rare earths. abstract. (Year: 2007).*
(Continued)

*Primary Examiner* — Nicholas A Wang

(57) ABSTRACT

The invention provides a preparation method of a nickel-based wrought superalloy wheel disk forging used at high temperature, in which the alloy has high content of solution strengthening elements W, Mo and strengthening phase γ' phase forming elements Al, Ti, Nb and γ' phase content reaches 55-65%. In view of a series of technical problems caused by high γ' phase to alloy smelting and forging, the high-temperature stress relief annealing, low-temperature stress relief annealing process of steel ingot and high temperature homogenizing annealing of steel bar were proposed by optimizing the thermal process of wheel disk forging and controlling the precipitation and dissolution of γ' phase.

6 Claims, 5 Drawing Sheets

(51) Int. Cl.
*C22C 1/02* (2006.01)
*C22C 19/05* (2006.01)

(58) Field of Classification Search
CPC .. C22F 1/10; B22D 7/005; C22B 9/18; C22B 9/20; B21J 5/02
See application file for complete search history.

(56) References Cited

FOREIGN PATENT DOCUMENTS

| | | | | |
|---|---|---|---|---|
| CN | 108441705 | A | | 8/2018 |
| CN | 110205523 | A | | 9/2019 |
| CN | 110468361 | A | | 11/2019 |
| CN | 111235434 | A | | 6/2020 |
| EP | 0292320 | A2 | | 11/1988 |
| GB | 1177391 | A | | 1/1970 |
| WO | WO2019217905 | | * | 11/2019 |

OTHER PUBLICATIONS

International Search Report of PCT Patent Application No. PCT/CN2020/098920 issued on Nov. 30, 2020.

* cited by examiner

PREPARATION METHOD OF NICKEL-BASED WROUGHT SUPERALLOY WHEEL DISK FORGINGS USED AT HIGH TEMPERATURE

CROSS-REFERENCE TO RELATED APPLICATION

This application is a continuation of international PCT application serial no. PCT/CN2020/098920 filed on Jun. 29, 2020, which claims a priority and benefit to China patent application No. 202010137240.1 filed on Mar. 2, 2020. The entirety of the above-mentioned patent applications are hereby incorporated by reference herein and made a part of this specification.

FIELD OF THE INVENTION

The present application pertains to the field of alloy preparation, and particularly relates to a preparation method of nickel-based wrought superalloy wheel disk forgings used at high temperature.

BACKGROUND ART

The service temperature of hot-end rotary wheel disk forgings, for example, a high-pressure compressor disk, a turbine disk or the like, of an aeroengine and gas turbine is gradually increased, with a maximum temperature exceeding 850° C. Therefore, the alloy materials required for the preparation of the disk forgings need to have excellent strength and plasticity in a range from room temperature to 850° C., high-temperature creep resistance and long-term structural property stability, as well as good casting and forging processing properties. At present, domestic nickel-based wrought superalloy wheel disk materials for an aeroengine cannot meet the long-term use requirements at 850° C. or higher.

The most effective way to increase the use temperature of the nickel-based high-temperature alloy is to increase the alloying degree and the content of a strengthening phase γ'. However, excessive alloying degree will induce high metallurgical segregation tendency and poor thermoplasticity in the alloy. Therefore, there are still difficulties in developing a new nickel-based wrought superalloy wheel disk material. Traditional nickel-based high-temperature alloys with γ' phase content of 55-65% can only be produced by powder metallurgy or casting (including equiaxed casting, directional solidification and single crystal solidification) processes. Produced by casting-forging processes, these alloys are faced with the problems of high segregation tendency, easy formation of metallurgical defects, poor hot working (forging) plasticity and so on, therefore, they are not suitable for preparing the nickel-based wrought superalloy wheel disk material.

Therefore, it is necessary to provide an improved technical solution to overcome the technical problems present in existing technologies.

SUMMARY

In order to solve the problems present in existing technologies, the present application provides a preparation method of a nickel-based wrought superalloy wheel disk forgings used at high temperature, which solves the problem that, at present, there is no high-performance wheel disk forgings material that can be used at 850° C. for a long time available. By optimizing and improving the key process steps in smelting and forging processes to solve the problems that high-alloyed nickel-based high-temperature alloy containing 55-65% γ' phase tends to suffer from metallurgical defects during smelting, easy cracking in forging and uneven structure, the nickel-based wrought superalloy wheel disk forging with the diameter of 100-1200 mm can be prepared, which has excellent 850° C. tensile strength, yield strength and lasting life.

The present application provides a preparation method of a nickel-based wrought superalloy used at high temperature, which includes the following steps:

step 1: weighing raw materials according to a composition proportion calculated in percentage by mass, in which the raw materials include: C: 0.01-0.08%, W: 6.5-8.0%, Cr: 7.5-11.0%, Mo: 1.5-3.5%, Co: 14.5-17.5%, Ti: 1.0-2.0%, Al: 4.0-5.5%, Nb: 1.0-2.0%, Zr: 0.005-0.05%, Mg: 0.005-0.05%; Ce: 0.001-0.05%, B: 0.005-0.05%, Fe: 0.01-1.5%, and the balance is Ni; and the raw materials further include impurity elements, in which P≤0.015%, Mn≤0.5%, Si≤0.5%, S≤0.015%, O≤0.005%, N≤0.01%, Ag≤0.005%, Ca≤0.01%, Sn≤0.01%, Pb≤0.001%, Cu≤0.5%, Ta≤0.5%, V≤0.5%;

step 2: smelting the raw materials into primary alloy ingots by vacuum induction smelting, the vacuum induction smelting process including the following steps of: evacuating, smelting, refining and tapping, in which the primary alloy ingot is subjected to high-temperature stress relief annealing after demoulding, then is subjected to electroslag remelting refining to obtain a secondary alloy ingot, and the secondary alloy ingot is subjected to low-temperature stress relief annealing after demoulding, and then is subjected to vacuum consumable remelting refining to obtain a tertiary alloy ingot, thus to obtain an alloy ingot;

step 3: subjecting the alloy ingot obtained in Step 2 to high-temperature homogenizing annealing to obtain a high-temperature homogenizing annealed alloy, in which the high-temperature homogenizing annealing includes the processes of heating, heat preservation and cooling, the heating rate is controlled to be 15-60° C./h, the temperature of the heat preservation is 1150-1250° C., and the time of the heat preservation is 24-72 h; and the cooling rate is controlled to be 5-55° C./h; and then subjecting the high-temperature homogenizing annealed alloy to heating, forging and cogging to obtain a bar, in which, after the bar is forged high-temperature homogenizing annealing is performed by increasing the temperature to a high-temperature homogenizing annealing temperature T at a rate of 10-50° C./h, in which the temperature T is Tγ'±30° C., and Tγ' is calculated by using the thermodynamic software Jmatpro according to the measured composition of the alloy;

step 4: cutting the bar obtained in Step 3 according to the weight of the wheel disk forgings to obtain a cut bar, and subjecting the cut bar to blank making and die forging to obtain an alloy wheel disk forging, in which the weight of the cut bar is 110-150% of the weight of the wheel disk forging, and the height-diameter ratio of the cut bar is controlled to be 1.5-3.0; and step 5: performing heat treatment on the alloy wheel disk forging obtained in Step 4 to obtain a nickel-based wrought superalloy wheel disk forging used at high temperature, in which the heat treatment includes a solid solution treatment, an intermediate aging treatment and an aging treatment, the solid solution treatment method includes performing heat preservation at 1150-1220° C. for 2-10 h, the intermediate aging treatment method includes performing heat preservation at 1000-

1150° C. for 2-10 h; and the aging treatment method includes performing heat preservation at 760° C.-920° C. for 8-32 h.

The inventor has found by research that the alloy prepared according to this technical solution can be used to prepare wheel forgings for long-term use at 850° C., which have a diameter of from 200 mm to 1200 mm, a tensile strength at 850° C. of more than 850 MPa, a yield strength of more than 700 MPa, and an endurance life at 850° C./350 MPa of more than 50 h. Moreover, the alloy prepared by the technical solution can be used for preparing the wheel disk forgings with an alloy diameter of 200-1200 mm by adopting smelting and forging equipment of existing high-temperature alloys, so as to achieve industrial production, uniform microstructure and good mechanical property, and effectively reduced internal stress in the forgings.

Further, in the preparation method, in the evacuating process, the vacuum degree is 10-100 Pa; in the process of the smelting stage, the temperature is controlled to be 1300° C.-1650° C.; in the refining process, the temperature is controlled to be 1400° C.-1600° C., and the vacuum degree is 1-20 Pa; and in the tapping process, the temperature is controlled to be 1420° C.-1590° C., and 10,000-50,000 Pa argon gas is filled for protection, cooling is performed for 0.5-3 h after casting, and then demoulding and cooling are performed to obtain a primary alloy ingot. The primary alloy ingot is subjected to high-temperature stress relief annealing treatment by transferring into an annealing furnace within 0.1 h-2 h, in which the temperature is increased to a high-temperature stress relief annealing temperature T at a rate of 10-50/h, the temperature of T is the total melting temperature of γ' phase Tγ'±50° C., and Tγ' is calculated from the measured composition of the alloy using a thermodynamic software Jmatpro. The present inventor has found by research that, by using this technical solution, alloy vacuum induction ingots can be prepared, in which alloy elements can be accurately controlled, and the steel ingots will not suffer from hot cracking or melting speed fluctuation during the remelting process, and thus can be used to prepare high quality electroslag remelting electrode or consumable remelting electrode.

Further, in the preparation method, Step 2 further includes: preparing the primary alloy ingot into an electroslag remelting electrode, in which the filling ratio of the electroslag remelting electrode to a crystallizer is 0.75-0.9. In the electroslag remelting process, the electroslag adopts a composition of $CaF_2$:CaO:MgO:$Al_2O_3$:$TiO_2$=65-75%: 10-20%:0.5-5%: 10-20%:0.5-5%, the steady-state melting speed is 1.0-6.0 kg/min, the cooling time of the secondary alloy ingot after electroslag remelting refining is 0.5 h-6 h, and, after cooling, demoulding is performed to obtain a secondary alloy ingot. After demoulding, the secondary alloy ingot is subjected to low-temperature stress relief annealing, in which the temperature is increased to a low-temperature stress relief annealing temperature T at a rate of 10-50° C./h, the temperature of T is Tγ'−100 to Tγ'−250° C., and Tγ' is calculated from the measured composition of the alloy using the thermodynamic software Jmatpro. The present inventor has found by research that, by using this technical solution, after the primary alloy ingot prepared by vacuum induction smelting is subjected to electroslag remelting, the content of inclusions and the content of harmful impurity element S in the alloy ingot can be effectively reduced, and, meanwhile, electroslag ingots with qualified components can be prepared for preparing a vacuum consumable remelting electrode, the quality of which can be remarkably improved. Especially, low-temperature stress relief annealing can effectively reduced the internal stress of the electrode. improve the process stability of the vacuum consumable remelting process, and avoid the fluctuation of the melting speed, so that an electrode of the vacuum consumable ingot with a diameter of 500 mm can be prepared.

Further, in the preparation method, Step 2 further includes: preparing the secondary alloy ingot into a consumable remelting electrode, in which the filling ratio of the consumable remelting electrode to the crystallizer is 0.75-0.95, and the melting speed is 1.0-5.0 kg/min; and, after finishing the vacuum consumable remelting refining, cooling the tertiary alloy ingot for 0.5 h-3 h, then demoulding and cooling. The present inventor has found by research that, through this technical solution, the above vacuum consumable remelting can remarkably improve the metallurgical quality of the steel ingots, as well as the compactness and the thermoplasticity of the steel ingots.

Further, in the preparation method, in Step 2, when the primary alloy ingot is an alloy ingot with a diameter less than 500 mm, the process of the primary alloy ingot is changed to: directly performing vacuum consumable remelting on the primary alloy ingot to obtain the alloy ingot. The present inventor has found by research that, through this technical solution, since consumable ingots smaller than 500 mm needs a small electrode diameter, preparing the electrode by vacuum induction ingot can obtain good metallurgical quality, which can not only shorten the technological process, but also effectively reduce the cost.

Further, in the preparation method, Step 3 further includes: after homogenizing annealing, heating the alloy ingot obtained in Step 2 to a forging temperature, keeping the temperature, discharging from a furnace, and forging to obtain a bar, in which the rate of temperature increase by heating before forging is controlled to be 15-60° C./h, the temperature is kept at 1050° C.-1180° C. for 2-8 h, the forging and cogging process includes upsetting and drawing out; heat preservation in a furnace is performed for 1-6 h after the single-fire forging time exceeds 5-30 min, asbestos is coated on the surface of the alloy ingot before each forging for heat preservation, and the total forging ratio is controlled to be 5-20. The bar is subjected to the high-temperature homogenizing annealing after forging is finished, in which the temperature is increased to the high-temperature homogenizing annealing temperature T at a rate of 10-50° C./h, the temperature of T is Tγ'±30° C., and Tγ' is calculated from the measured composition of the alloy using the thermodynamic software Jmatpro. The present inventor has found by research that, through this technical solution, a quick forging machine can be used for forging and cogging the steel ingot, the steel ingot does not crack, and an as-cast structure can be converted into an equiaxed crystal structure.

Further, in the preparation method, Step 4 further includes: heating the cut bar, upsetting and making blank to obtain a disk blank, in which the rate of temperature increase by heating before forging is controlled to be 20-50° C./h, the temperature is kept at 1000° C.-1150° C. for 2-8 h, and the upsetting deformation is 30-70%. The present inventor has found by research that, through this technical solution, a stable bar upsetting process is achieved, and forging defects such as forging cracks, large and small heads, wrinkles and the like are avoided.

Furthermore, in the preparation method, the disk blank is subjected to die forging after being heated, in which the rate of temperature increase by heating before forging is controlled to be 20-50° C./h, the temperature is kept at 950° C.-1150° C. for 2-8 h, the die forging deformation is 30-70%, and the die heating temperature is 300-1050° C. The present inventor has found by research that, through this technical solution, die forging of the wheel disk forgings can be realized with good mold filling effect and structure uniformity, without suffering from forging cracking.

The beneficial effects of the present application are as follow:

the present application provides a new method for preparing an ultra-high temperature nickel-based wrought superalloy, by which wheel disk forgings with a diameter of 100-1200 mm can be prepared via a casting-forging process, and have good mechanical properties and satisfactory service stability in the temperature range of 850-900° C., which fills the domestic gap regarding a long-term wrought disk material at 850° C.

BRIEF DESCRIPTION OF THE DRAWINGS

In order to explain the technical solution of the present application more clearly, the figures that need to be used in the examples will be briefly described below. It is to be understood that, the attached figures illustrate only certain examples of the invention and should not be considered as limiting the scope of the present application. For those skilled in the art, other relevant figures can be obtained from these figures without paying any inventive effort.

DETAILED DESCRIPTION

Experimental procedures for which specific conditions are not indicated in the following examples are generally determined in accordance with national standards. If there is no corresponding national standard, it is performed according to general international standards, conventional conditions, or conditions recommended by the manufacturer.

The features mentioned in the present application or the features mentioned in the examples may be combined with each other. All of the features disclosed in this specification may be combined in any combination, and each feature disclosed in this specification may be replaced by any alternative feature serving the same, equivalent or similar purpose. Thus, unless expressly stated otherwise, the features disclosed are only general examples of equivalent or similar features.

In the present application, all the technical features mentioned herein, as well as the preferred features, may be combined with each other to form a new technical solution, unless otherwise specified.

In the present application, if not specifically stated, the nickel-based wrought superalloy referred to herein includes impurity elements such as P, Mn, Si, S, O, N, Ag, Ca, Sn, Pb, Cu, Ta, V, etc.

For easy understanding of the technical means, inventive features, objects and effects of the present application, the present application will be further elucidated with reference to specific examples thereof, including but not limited to these examples.

In order to develop a nickel-based wrought superalloy wheel disk material which can be used for long time at 850° C. and has controllable cost, on one hand, noble metals such as Ta, Re and the like or strategic reserve elements such as Co and rare earth and the like are not added or added in small amount, and conventional elements of a traditional nickel-based wrought superalloy wheel disk material are used as much as possible; and, on the other hand, it should be guaranteed that the alloy have satisfactory performance at 850° C., and, at the same time, taking into consideration the casting-forging technological performance of the alloyd, the wheel disk forging piece with the diameter of 100-1200 mm should be able to be prepared by utilizing existing smelting and forging equipment, so as to realize batch production at low cost.

In order to improve the cleanliness, homogeneity and compactness of the cast ingots, after vacuum induction smelting and casting of a primary alloy ingot with qualified components, electroslag remelting refining is adopted to remove inclusions and S elements and improve the metallurgical quality of the alloy ingot, and then vacuum consumable remelting refining is adopted to further improve the metallurgical quality and obtain the alloy ingot with certain thermoplasticity.

Figure 1:
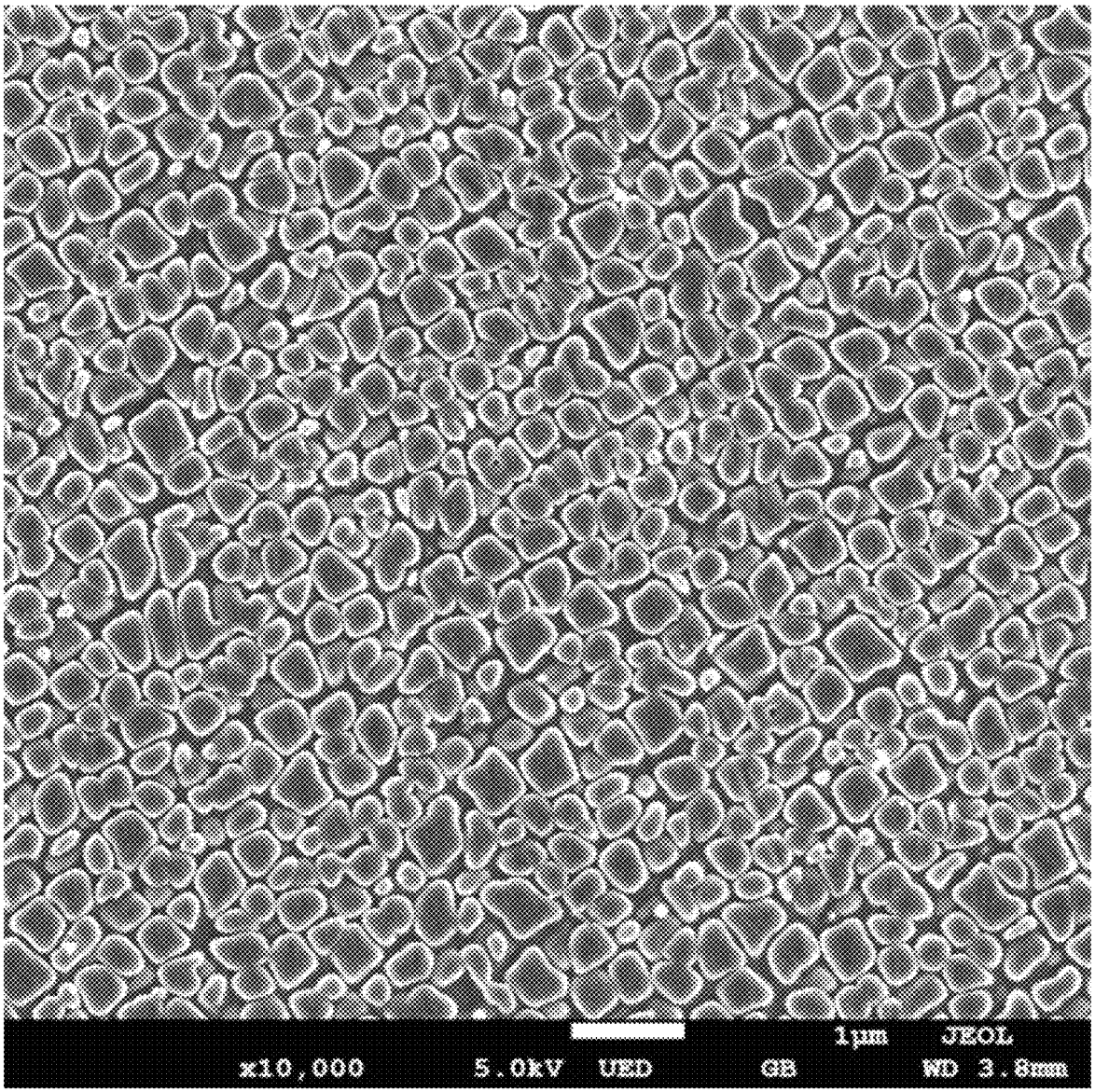
FIG. 1 is a scanning electron microscope morphology of γ' phase of alloy wheel disk forgings of the present application.
Figure 2:
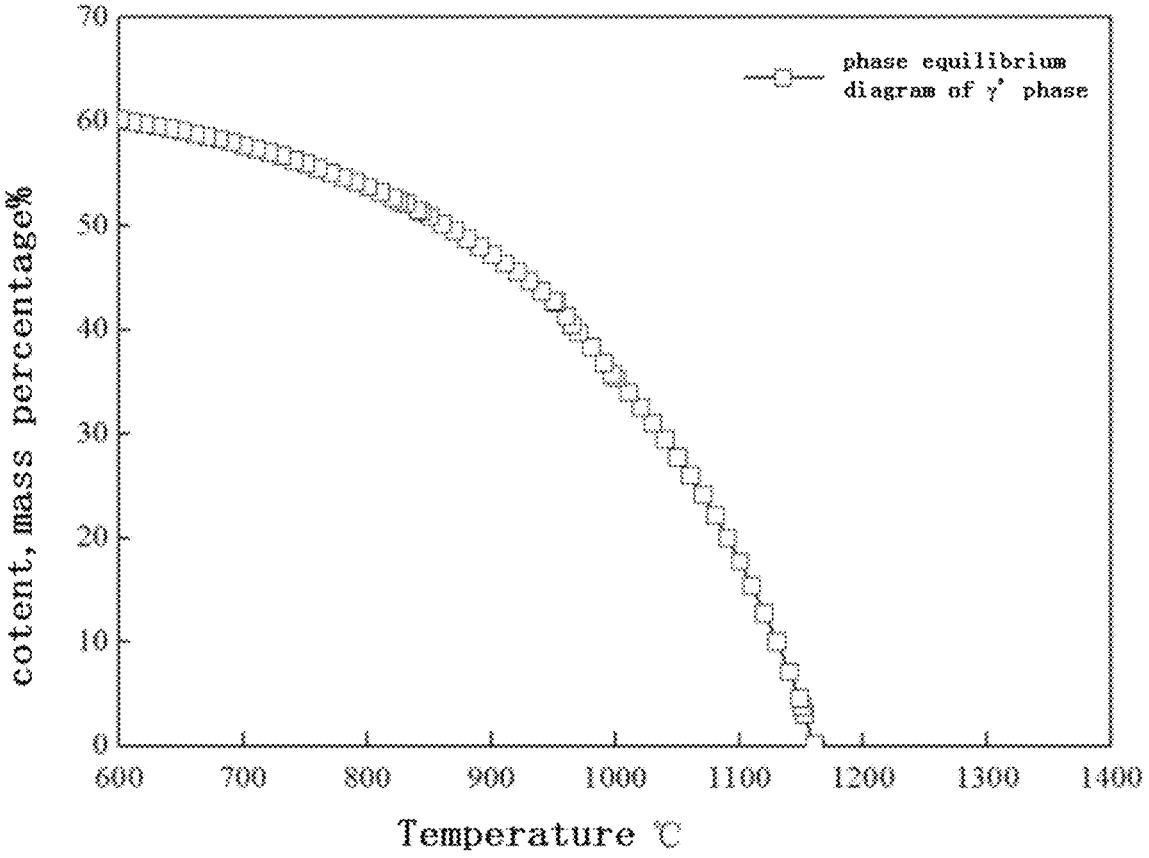
FIG. 2 is an equilibrium phase diagram of γ' phase having a certain composition of the alloy of the present application.
Figure 3:
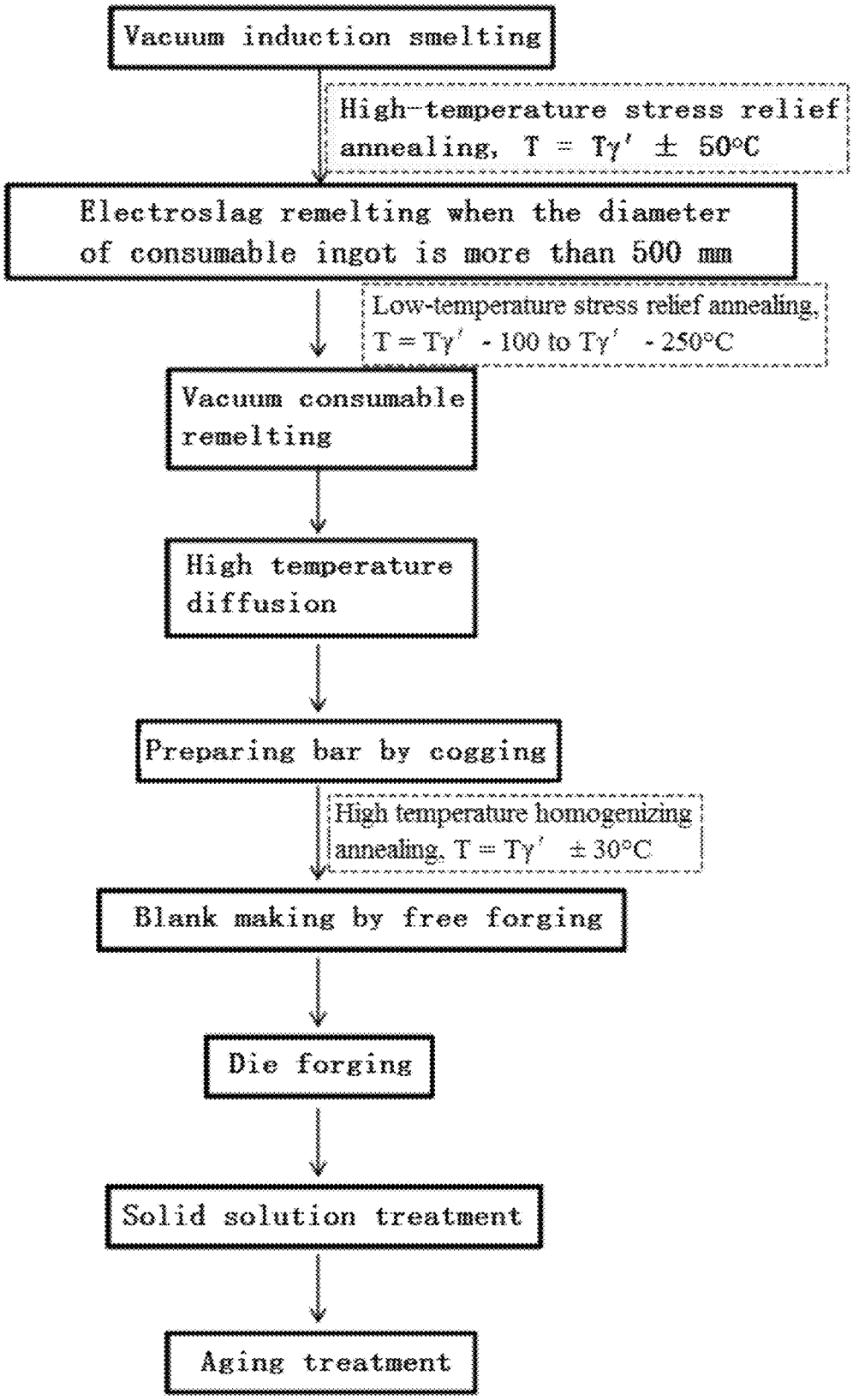
FIG. 3 is a process flow diagram for preparing the alloy wheel disk forgings of the present application.

Upon continuous exploring, the present inventor has proposed an alloy having high content of solution strengthening elements W, Mo and strengthening phase γ' phase forming elements Al, Ti, Nb, in which γ' phase content reaches 55-65% (see FIGS. 1 and 2). In view of a series of technical problems caused by high γ' phase to alloy smelting and forging, a high-temperature stress relief annealing, low-temperature stress relief annealing process of steel ingots and high temperature homogenizing annealing of steel bars were proposed by optimizing the thermal history of wheel disk forging and controlling the precipitation and dissolution of γ' phase, as shown in FIG. 3, which solves the problems that the smelting and forging of nickel-based wrought superalloy wheel disk forgings used at high temperature of 850° C. tends to suffer from cracking and uneven structure.

Upon continuous exploring of the present inventor, it was found in experiments that, in order to improve the use temperature of Ni-base wrought superalloys and the alloying degree, increasing the content of the precipitation phase γ' phase is the most effective measure. Meanwhile, the inventor has found in experiments that, due to the fact that the alloying degree of the alloy is high, the weight and the content of the alloy elements are high, and the content of the precipitation phase γ' phase is high, on the one hand, the high-content alloy elements generate strong dendritic element segregation in the casting process after vacuum induction smelting of the alloy, and more solidification porosity is formed; on the other hand, due to the low thermal conductivity of the alloy, larger thermal stress will be formed, and during the cooling process, larger structural stress can be formed due to the precipitation of γ' phases. After the ingot is cast, if the ingot is not timely demoulded and annealed, the thermal stress and the structural stress in the ingot are superposed, when the stress is too large, the ingot is thermally cracked, and meanwhile, more looseness in the ingot can accelerate crack propagation.

The present inventor has found in experiments that, for vacuum induction smelting, after molten steel refining is finished, when pouring tapping steel into a mold made of cast iron, heat is radiated in a vacuum chamber through heat radiation, so that the cooling condition is slow, the solidification speed of molten steel is slow, and the temperature difference between the inside and the outside is large, thus large thermal stress and structural stress will be formed. In particular, the γ' phase content of the alloy of the present application is as high as 55-60% (see FIGS. 1 and 2), the total solution temperature of the γ' phase is 1155-1170° C. (Tγ'), and the γ' phase is continuously precipitated when the temperature is lower than Tγ' during the cooling process after the molten steel is poured, thereby generating structural stress, which increases the risk of thermal cracking after ingot demoulding and in the process of electroslag remelting or consumable remelting, leads to steel ingot scrapping due to hot cracking after demoulding, or form metallurgical defects due to melting speed fluctuation caused by hot cracking during electroslag remelting or consumable remelting. Therefore, the present application provides a high-temperature stress relief annealing process aiming at a primary alloy ingot prepared by vacuum induction smelting, including a process design idea that, the ingot is timely demoulded and transferred to the annealing furnace within a specified period of time after demoulding, and the annealing furnace is heated to temperature T at a certain heating rate, so that the γ' phase gradually are redissolved under this temperature condition and, in turn, plays the role of eliminating the thermal stress and the structural stress.

The inventor found through experiments that, for electroslag remelting, by inserting an electroslag remelting electrode into a slag pool and dripped into a water-cooled crystallizer in the form of molten drops after being subjected to slag heat resistance melting, the thermal stress and the structural stress can be effectively reduced, since compared with vacuum induction smelting, the molten steel pool of the electroslag remelting ingot is shallow, and the solidification speed of the molten steel is high. However, if the electroslag ingot is not annealed after demoulding, there will be a large thermal cracking risk, since melting speed fluctuation might occur randomly in the vacuum consumable remelting process when the electroslag ingot is directly used for preparing consumable remelting electrodes. Therefore, the present application provides a low-temperature stress relief annealing process aiming at a primary alloy ingot prepared by vacuum induction smelting, including a process design idea that, the ingot is timely demoulded and transferred to the annealing furnace within a specified period of time after demoulding, and the annealing furnace is heated to temperature T at a certain heating rate, so that the γ' phase is gradually coarsened and grown and the full precipitation of all parts of the steel ingot is ensured under such temperature condition, which can effectively reduce the internal stress of the steel ingot and avoid the fluctuation of the melting speed during the consumable remelting process, and at the same time, the energy cost can be effectively saved by omitting a high-temperature stress relief annealing process.

Figure 4:
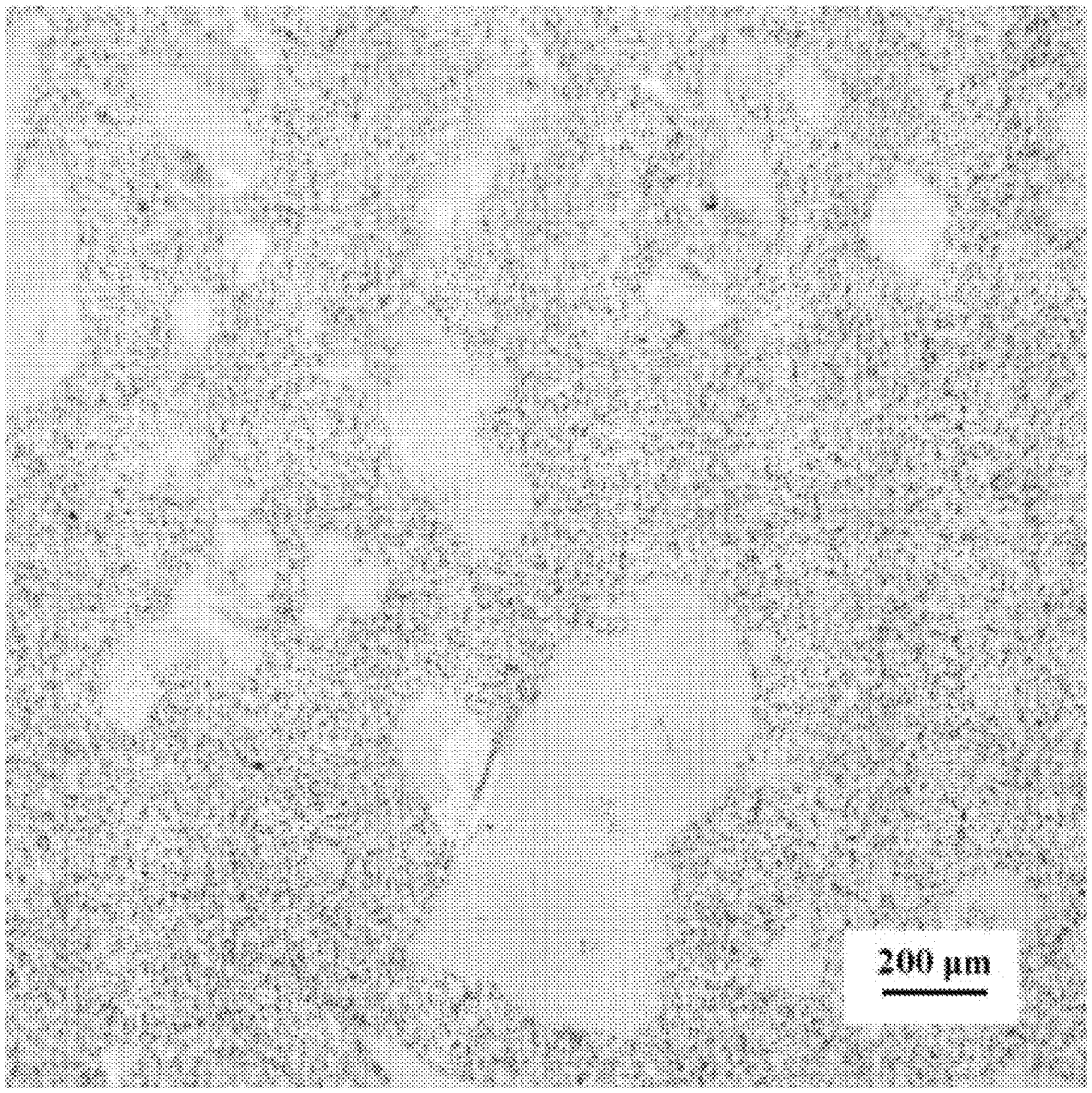
FIG. 4 shows the metallographic morphology of abnormally coarse grains remained due to an improper preparation process of the alloy wheel of the present application.
Figure 5:
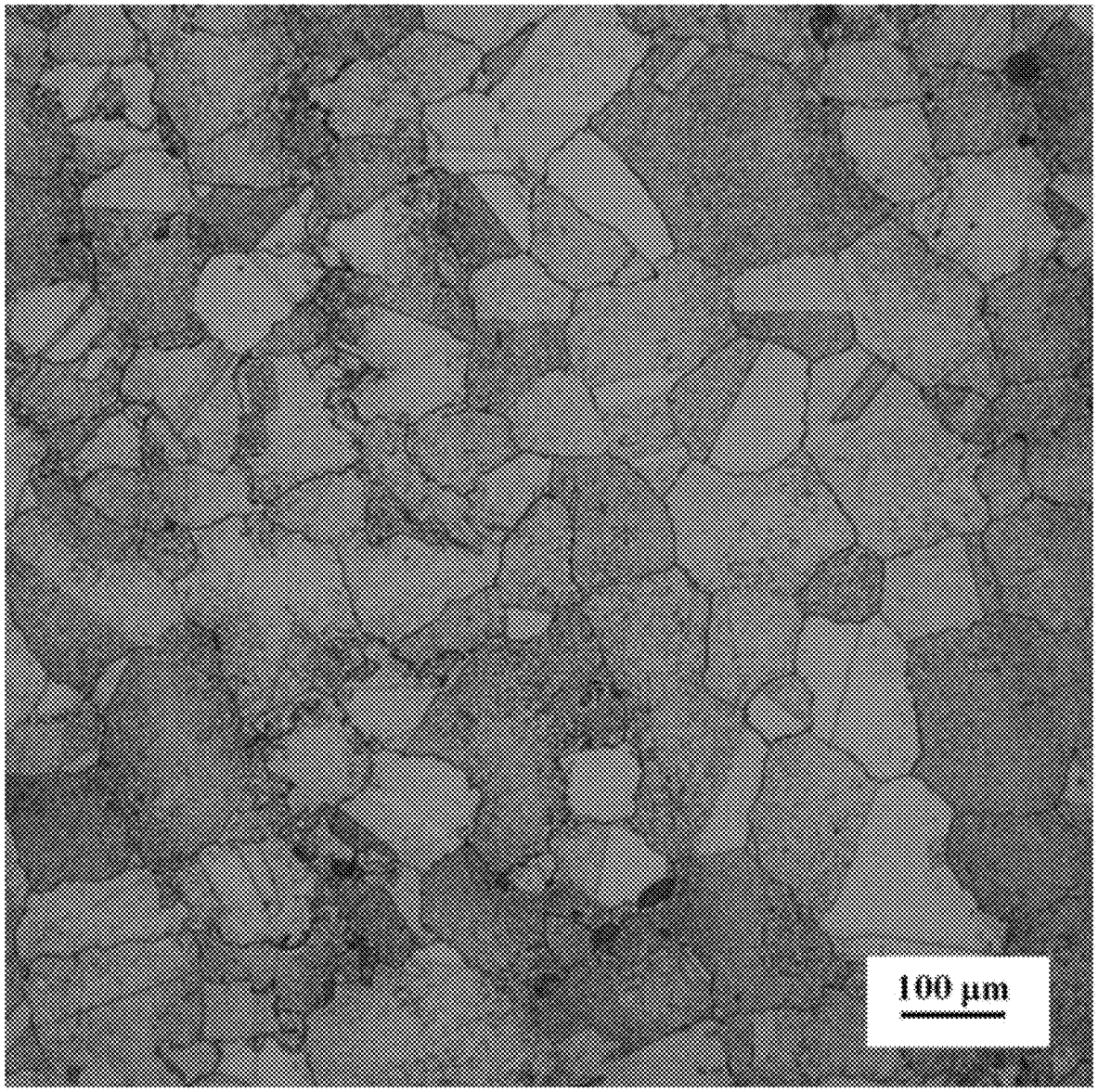
FIG. 5 shows the normal grain metallographic morphology of the alloy wheel disk forgings of the present application.

The present inventor has found through experiments that, for the cogging of the steel ingot to prepare the bar, due to the high total melting temperature of the γ' phase of the alloy, the γ' phase of the alloy is easy to precipitate during cogging, resulting in a decrease in the thermoplasticity of the steel ingot and an increase in wrought resistance, and, meanwhile, due to the action of the γ' phase locking dislocation, the dynamic recrystallization of the alloy will be inhibited, so that an abnormal coarse grain structure will be remained (see FIG. 4), the structure and the performance uniformity of the wheel disk forging will be influenced, and, in severe cases, the wheel disk forgings will be scrapped. Therefore, the present inventor proposed a high-temperature homogenizing annealing process for a secondary alloy ingot prepared by electroslag remelting. The idea of process design involves in preparing bar by ingot cogging and forging. After forging, high-temperature homogenizing annealing is carried out. The temperature is increased to high-temperature homogenizing annealing temperature T at a rate of 10-50° C./h. At this temperature γ' phase is properly redissolved, and the action of γ' phase locking dislocation disappears. Then static recrystallization occurs in the alloy to form equiaxed grains with uniform structure to achieve homogenization of structure, which in turn provides a bar with uniform structure for subsequent blank making and die forging.

The following table is an alloy composition table and a technical effect comparison table of examples and comparative examples.

TABLE 1

Alloy composition of examples and comparative examples (values in the table are percentage values)

| Examples | C | W | Cr | Mo | Co | Ti | Al | Nb | Zr | Mg | Ce | B | Fe | Ni | Tγ'//° C. |
|---|---|---|---|---|---|---|---|---|---|---|---|---|---|---|---|
| Example 1 | 0.04 | 6.9 | 7.7 | 2 | 15 | 1.5 | 4.5 | 1.5 | 0.004 | 0.004 | 0.004 | 0.004 | 0.004 | balance | 1152 |
| Example 2 | 0.01 | 7.9 | 10 | 3 | 16 | 1.7 | 5 | 1.7 | 0.01 | 0.01 | 0.01 | 0.01 | 1 | balance | 1175 |
| Example 3 | 0.08 | 6.5 | 7.5 | 1.5 | 14.5 | 1 | 4 | 1 | 0.005 | 0.005 | 0.005 | 0.005 | 0.01 | balance | 1055 |
| Example 4 | 0.06 | 8 | 11 | 3.5 | 17 | 2 | 5.5 | 2 | 0.05 | 0.05 | 0.05 | 0.05 | 1.5 | balance | 1172 |
| Example 5 | 0.03 | 7.5 | 8 | 2 | 15 | 1.2 | 4.5 | 1.2 | 0.03 | 0.03 | 0.03 | 0.03 | 0.02 | balance | 1130 |
| Example 6 | 0.04 | 7 | 10 | 3.2 | 16.5 | 1.8 | 5.2 | 1.8 | 0.02 | 0.02 | 0.02 | 0.02 | 1.2 | balance | 1178 |
| Comparative Example 1 | 0.045 | 6.8 | 10.5 | 2.6 | 16.2 | 1.55 | 4.52 | 1.46 | 0.002 | 0.001 | 0.001 | 0.003 | 1.2 | balance | 1139 |
| Comparative Example 2 | 0.045 | 4.8 | 10.5 | 4.8 | 16.2 | 1.55 | 4.52 | 1.46 | 0.017 | 0.011 | 0.005 | 0.013 | 2.2 | balance | 1129 |

TABLE 2

Comparison of process and physicochemical test results between Examples and Comparative Examples

| | Alloy ingot diameter/mm | Smelting process | Wheel disk forging diameter/mm | Metallurgy and forging defects | Structure aging at 850° C. for 3000 h | 850° C. Tensile properties: Tensile strength Degree/MPa | Strength of yield Degree/MPa | Extension Rate/% | Contraction Rate/% | 850° C./350 MPa endurance life/h |
|---|---|---|---|---|---|---|---|---|---|---|
| Example 1 | 305 | Duplex | 100 | No | Good | 885 | 736 | 8.5 | 12.5 | 96 |
| Example 2 | 460 | Duplex | 550 | No | Good | 934 | 742 | 6.2 | 8.3 | 85 |
| Example 3 | 508 | Triad | 900 | No | Good | 820 | 685 | 10.5 | 12.9 | 43 |
| Example 4 | 508 | Triad | 900 | No | Good | 897 | 748 | 8.6 | 11.8 | 92 |
| Example 5 | 610 | Triad | 1200 | No | Good | 923 | 763 | 6.5 | 9.2 | 134 |
| Example 6 | 508 | Triad | 600 | No | Good | 916 | 751 | 8.4 | 11.5 | 148 |
| Example 7 | 430 | Triad | 600 | No | Good | 906 | 731 | 7.4 | 10.5 | 108 |
| Comparative Example 1 | 508 | Duplex | 900 | Black spot defect, forging crack | Good | 908 | 713 | 6.4 | 8.8 | 38 |
| Comparative Example 2 | 508 | Triad | 900 | No | Mixed crystal, σ phase and μ phase precipitating | 898 | 715 | 4.5 | 6.2 | 112 |

Example 1. Preparation Method of Nickel-Based Wrought Superalloy Disk Forgings for Long-Term Use at 850° C.

This example prepared nickel-based wrought superalloy disk forgings for long-term use at 850° C. (having a diameter of 200 mm), the alloy composition of which is shown in the part of Table 1 regarding Example 1.

The preparation process of the alloy wheel disk forgings is shown in FIG. 3 and includes the following steps:

Step 1: the smelting adopted a duplex process (namely vacuum induction smelting and vacuum consumable remelting), in which the diameter of the primary alloy ingot obtained by vacuum induction smelting was 250 mm, and the diameter of the alloy ingot obtained by vacuum consumable remelting was 305 mm. The vacuum induction smelting included the following steps of: weighing raw materials according to the element composition of the alloy, and performing vacuum induction smelting. The vacuum induction smelting process included steps of evacuating, melting, refining and tapping, in which the vacuum degree in the evacuation period was 10 Pa, the temperature in the melting period was controlled at 1300° C., the temperature in the refining period was controlled at 1400° C., the vacuum degree in the refining period was 1 Pa, the tapping temperature was controlled at 1420° C., and 20,000 Pa argon was filled for protection during tapping. After casting, cooling was carried out for 0.5 h, and then demoulding and cooling were performed. After demoulding, the temperature was increased to a high-temperature stress relief annealing temperature T at a rate of 50° C. It was calculated that the total solution temperature Tγ' of the γ' phase was 1152° C., and the annealing temperature was Tγ'−20° C. Cooling was performed to obtain the primary alloy ingot. The primary alloy ingot was machined to obtain the consumable remelting electrode. The filling ratio of the electrode to the crystallizer was 0.75, and the melting speed was 1.0 kg/min. After melting, the tertiary alloy ingot was cooled for 0.5 h, demoulded and cooled to obtain the alloy ingot.

Step 2: high-temperature homogenizing annealing treatment was performed on the alloy ingot, including the processes of heating, heat preservation and cooling, in which the rate of temperature increase was controlled to be 15° C./h, the temperature was kept at 1150° C. for 24 h, and the cooling rate was controlled to be 5° C./h. After homogenizing and annealing, the alloy ingot was machined, heated to a forging temperature, kept at the temperature and then discharged out of a furnace for forging. Before forging, the rate of temperature increase by heating was controlled to be 15° C./h, and the temperature was kept at 1050° C. for 2 h. The forging and cogging process included upsetting and drawing out. A single-fire forging time was controlled to be 1 min to 5 min, and, after the single-fire forging time exceeded 5 min, the alloy ingot was returned to the furnace for heat preservation for 1 h. Before each forging, the alloy ingot was coated with asbestos on the surface for heat preservation. The total forging ratio was controlled to be 5. After forging, the bar was subjected to the high-temperature homogenizing annealing, in which the temperature was increased to the high-temperature homogenizing annealing temperature T at a rate of 45° C./h. It was calculated that the total melting temperature Tγ' of the γ' phase was 1152° C., and the annealing temperature was Tγ'−30° C.

Step 3: a bar with an appropriate length was cut according to 140% of the weight of the wheel disk forging, with a bar height-diameter ratio of 1.5. The bar was heated, upset, and made into a disk blank, in which the rate of temperature increase by heating before forging was controlled to be 20° C./h, the temperature was kept at 1000° C. for 2 h, and the upsetting deformation was controlled to be 30%. After heating, the disk blank was die forged to obtain alloy wheel disk forgings, in which the rate of temperature increase by heating before forging was controlled to be 20° C./h, the temperature was kept at 950° C. for 2 h, the die forging deformation amount was 30%, and the die heating temperature was 300° C.

Step 4: the wheel disk forgings were subjected to machining and heat treatment including a solid solution treatment, an intermediate aging treatment and an aging treatment, in which the solid solution treatment system was 1150° C. for 2 h, the intermediate aging treatment system was 1000° C. for 2 h, and the aging treatment system was 760° C. for 8 h.

In some embodiments of this example, the starting material may be one or more selected from the group consisting of metal nickel, metal chromium or nichrome, metal titanium, metal aluminum, metal molybdenum, ferroboron, metal cobalt, metal tungsten, nickel-tungsten alloys, niobium-nickel alloys, ferrovanadium, carbon electrodes and master alloys.

Example 2. Preparation Method of Nickel-Based Wrought Superalloy Disk Forgings Having a Diameter of 550 mm for Long-Term Use at 850° C.

This example prepared nickel-based wrought superalloy disk forgings having a diameter of 550 mm for long-term use at 850° C., the alloy composition of which is shown in Example 2 in Table 1.

The preparation process of the alloy wheel disk forgings is shown in FIG. 3 and includes the following steps:

Step 1: the smelting adopted a duplex process, that is, vacuum induction smelting+vacuum consumable remelting, in which the diameter of the primary alloy ingot in vacuum induction smelting was 370 mm, and the diameter of the alloy ingot in vacuum consumable remelting was 460 mm. The vacuum induction smelting included the following steps of: weighing raw materials according to the element proportion of the alloy, and performing vacuum induction smelting. The vacuum induction smelting process included the steps of evacuating, melting, refining and tapping, in which the vacuum degree in the evacuating period was 100 Pa, the temperature in the melting period was controlled to be 1650° C., the temperature in the refining period was controlled to be 1600° C., the vacuum degree in the refining period was 20 Pa, the tapping temperature was controlled to be 1590, and 50,000 Pa argon was filled for protection during tapping. After casting, cooling was carried out for 3 h, demoulding was performed, and the temperature was increased to a high-temperature stress relief annealing temperature T at a rate of 40° C./h. It was calculated that the total solution temperature Tγ' of the γ' phase was 1175° C., and the annealing temperature was Tγ'+10° C. Cooling was performed to provide the primary alloy ingot. The primary alloy ingot was machined to obtain the consumable remelting electrode. The filling ratio of the electrode to the crystallizer was 0.95, and the melting speed was 6.0 kg/min. After melting, the secondary alloy ingot was cooled for 3 h, demoulded and cooled to obtain the alloy ingot.

Step 2: high-temperature homogenizing annealing was performed on the alloy ingot, including the processes of heating, heat preservation and cooling, in which the rate of temperature increase was controlled to be 60° C./h, the temperature was kept at 1250° C. for 72 h, and the cooling rate was controlled to be 55° C./h. After homogenizing and annealing, the alloy ingot was machined, heated to a forging temperature, kept at the temperature and then discharged out of the furnace for forging. The rate of temperature increase by heating before forging was controlled to be 60° C./h, and the temperature was kept at 1180° C. for 8 h. The forging and cogging process included upsetting and drawing out. A single-fire forging time was controlled to be 1 min to 30 min, and, after the single-fire forging time exceeded 30 min, the alloy ingot was returned to the furnace for heat preservation for 6 h. Before each forging, the alloy ingot was coated with asbestos on the surface for heat preservation. The total forging ratio was controlled to be 20. After forging, the bar was subjected to high-temperature homogenizing annealing, in which the temperature was increased to the high-temperature homogenizing annealing temperature T at a rate of 50° C./h. It was calculated that the total melting temperature Tγ' of the γ' phase was 1175° C., and the annealing temperature was Tγ'−10° C.

Step 3: a bar was cut according to 130% of the weight of the wheel disk forging, with a bar height-diameter ratio of 3.0. The bar was heated, upset, and made into a disk blank, in which the rate of temperature increase by heating before forging was controlled to be 50° C./h, the temperature was kept at 1140° C. for 8 h, and the upsetting deformation was controlled to be 70%. After heating, the disk blank was die forged to obtain alloy wheel disk forgings, in which the rate of temperature increase by heating before forging was controlled to be 50° C./h, the temperature was kept at 1120° C. for 8 h, the die forging deformation amount was 70%, and the die heating temperature was 1050° C.

Step 4: the wheel disk forgings were subjected to machining and heat treatment including a solid solution treatment, an intermediate aging treatment and an aging treatment, in which the solid solution treatment system was 1220° C. for 10 h, the intermediate aging treatment system was 1150° C. for 10 h, and the aging treatment system was 920° C. for 32 h.

In some embodiments of this example, the starting material may be one or more selected from the group consisting of metal nickel, metal chromium or nichrome, metal titanium, metal aluminum, metal molybdenum, ferroboron, metal cobalt, metal tungsten, nickel-tungsten alloys, niobium-nickel alloys, ferrovanadium, carbon electrodes and master alloys.

Example 3. A Nickel-Based Wrought Superalloy Wheel Disk Forgings Having a Diameter of 900 mm for Long-Term Use at 850° C.

This example prepared a nickel-based wrought superalloy disk forgings for long-term use at 850° C., the alloy composition of which is shown in Example 3 in Table 1.

The preparation process of the alloy wheel disk forging is shown in FIG. 3 and includes the following steps:

Step 1, the smelting adopts a triad process, that is, vacuum induction smelting+electroslag remelting+vacuum consumable remelting, in which the diameter of the primary alloy ingot in vacuum induction smelting was 355 mm, the diameter of the alloy ingot in vacuum consumable remelting was 423 mm, and the diameter of the alloy ingot in vacuum consumable remelting is 508 mm. The vacuum induction smelting included the following steps of: weighing raw materials according to the element proportion of the alloy, and performing vacuum induction smelting. The vacuum induction smelting process included the steps of evacuating, melting, refining and tapping, in which the vacuum degree in the evacuating period was 20 Pa, the temperature in the melting period was controlled to be 1550° C., the temperature in the refining period was controlled to be 1500° C., the vacuum degree in the refining period was 4 Pa, the tapping temperature was controlled to be 1480° C., and 20,000 Pa argon was filled for protection during tapping. After casting, cooling was carried out for 2.5 h, demoulding was performed, and the temperature was increased to a high-temperature stress relief annealing temperature T at a rate of 30° C./h. It was calculated that the total solution temperature Tγ' of the γ' phase was 1055° C., and the annealing temperature was Tγ'+50° C. Cooling was performed to provide the primary alloy ingot. The primary alloy ingot was machined to obtain an electroslag remelting electrode. The filling ratio of electrode to crystallizer was 0.9, the composition of electroslag was CaF2:CaO:MgO:Al2O3:TiO2=65%:10%:0.5%:10%:0.5%, and the steady-state melting speed was 5.0 kg/min. After melting, the secondary alloy ingot was cooled for 0.5 h, demoulded, and heated to the low-temperature stress relief annealing temperature T at the rate of 30° C./h. It was calculated γ' phase total solution temperature Tγ' was 1055° C., and the annealing temperature was Tγ'−200° C. A secondary alloy ingot was obtained after cooling. The electroslag remelting electrode was prepared by machining the secondary alloy ingot. With a filling ratio 0.75 of electrode to crystallizer and a melting speed of 1.0 kg/min, a tertiary alloy ingot was melted, cooled for 1 h, demoulded, and cooled to obtain the alloy ingot.

Step 2, high-temperature homogenizing annealing was performed on the alloy ingot, including the processes of heating, heat preservation and cooling, in which the rate of temperature increase was controlled to be 35° C./h, the temperature was kept at 1190° C., the temperature was kept for 50 h, and the cooling rate was controlled to be 25° C./h. After homogenizing and annealing, the alloy ingot was machined, heated to a forging temperature, kept at the temperature and then discharged out of a furnace for forging. Before forging, the rate of temperature increase by heating was controlled to be 35° C./h, and the temperature was kept at 1170° C. for 6 h. The forging and cogging process included upsetting and drawing out. A single-fire forging time was controlled to be 1 min to 15 min, and, after the single-fire forging time exceeded 15 min, the alloy ingot was returned to the furnace for heat preservation for 2 h. Before each forging, the alloy ingot was coated with asbestos on the surface for heat preservation. The total forging ratio was controlled to be 15. After forging, the bar was subjected to a high-temperature homogenizing annealing, in which the temperature was increased to the high-temperature homogenizing annealing temperature T at a rate of 30° C./h. It was calculated that the total melting temperature Tγ' of the γ' phase was 1055° C., and the annealing temperature was Tγ'+30° C.

Step 3, a bar was cut according to 140% of the weight of the wheel disk forging, with a height-diameter ratio of 2.5. The bar was heated, upsett and made into a disk blank, in which the rate of temperature increase by heating before forging was controlled to be 35° C./h, the temperature was kept at 1110° C. for 4 h, and the upsetting deformation was controlled to be 40%. After heating, the disk blank was die forged to obtain alloy wheel disk forgings, in which the rate of temperature increase by heating before forging was controlled to be 35° C./h, the temperature was kept at 1120° C. for 4 h, the die forging deformation amount was controlled to be 40%, and the die heating temperature was 650° C.

Step 4, the wheel disk forgings were subjected to machining and heat treatment including a solid solution treatment, an intermediate aging treatment and an aging treatment, in which the solid solution treatment system was 1180° C. for 5 h, the intermediate aging treatment system was 1050° C. for 8 h, and the aging treatment system was 910° C. for 20 h.

In some embodiments of this example, the starting material may be one or more selected from the group consisting of metal nickel, metal chromium or nichrome, metal titanium, metal aluminum, metal molybdenum, ferroboron, metal cobalt, metal tungsten, nickel-tungsten alloys, niobium-nickel alloys, ferrovanadium, carbon electrodes and master alloys.

Example 4. A Nickel-Based Wrought Superalloy Disk Forgings Having a Diameter of 900 mm for Long-Term Use at 850° C.

This example prepared nickel-based wrought superalloy disk forgings having a diameter of 900 mm for long-term use at 850° C., the alloy composition of which is shown in Example 4 in Table 1.

The preparation process of the alloy wheel disk forgings is shown in FIG. 3 and includes the following steps:

Step 1, the smelting adopted a triad process, that is, vacuum induction smelting+electroslag remelting+vacuum consumable remelting, in which the diameter of the primary alloy ingot through vacuum induction smelting was 355 mm, the diameter of the electroslag remelting alloy ingot was 423 mm, and the diameter of the alloy ingot through vacuum consumable remelting was 508 mm. The vacuum induction smelting included the following steps of: weighing raw materials according to the element proportion of the alloy, and performing vacuum induction smelting. The vacuum induction smelting process included the steps of evacuation, melting period, refining and tapping, in which the vacuum degree in the evacuating period was 30 Pa, the temperature in the melting period was controlled to be 1580° C., the temperature in the refining period was controlled to be 1550° C., the vacuum degree in the refining period was 5 Pa, the tapping temperature was controlled to be 1480° C., and 25,000 Pa argon was filled for protection during tapping. After casting, cooling was carried out for 3 h, demoulding was performed, and the temperature was increased to a high-temperature stress relief annealing temperature T at a rate of 25° C. It was calculated that the total solution temperature Tγ' of the γ' phase was 1172° C., and the annealing temperature was Tγ'−50° C., Cooling was performed to provide the primary alloy ingot. The primary alloy ingot was machined to obtain an electroslag remelting electrode. The filling ratio of electrode to crystallizer was 0.9, the composition of electroslag was CaF2:CaO:MgO:Al2O3:TiO2=75%:20%:5%:20%:5%, and the steady-state melting speed was 4.0 kg/min. After melting, the secondary alloy ingot was cooled for 6 h, demolded, and heated to the low-temperature stress relief annealing temperature T at the rate of 20° C./h It was calculated that the γ' phase total solution temperature Tγ' was 1172° C., and the annealing temperature was Tγ'−150° C. A secondary alloy ingot was obtained after cooling. The electroslag remelting electrode was prepared by machining the secondary alloy ingot. With a filling ratio 0.87 of the electrode to the crystallizer and a melting speed of 3.8 kg/min, a tertiary alloy ingot was melted, cooled for 3 h, demoulded, and cooled to obtain the alloy ingot.

Step 2, high-temperature homogenizing annealing was performed on the alloy ingot, including the processes of heating, heat preservation and cooling, in which the rate of temperature increase was controlled to be 20° C./h, the temperature was kept at 1180° C., the temperature was kept for 70 h, and the cooling rate was controlled to be 5° C./h. After homogenizing and annealing, the alloy ingot was machined, heated to a forging temperature, kept at the temperature, and then discharged out of a furnace for forging. Before forging, the rate of temperature increase by heating was controlled to be 15° C./h, and the temperature was kept at 1180° C. for 6 h. The forging and cogging process included upsetting and drawing out. A single-fire forging time was controlled to be 1 min to 10 min, and, after the single-fire forging time exceeded 10 min, the alloy ingot was returned to the furnace for heat preservation for 2 h. Before each forging, the alloy ingot was coated with asbestos on the surface for heat preservation. The total forging ratio was controlled to be 10. After forging, the bar was subjected to the high-temperature homogenizing annealing after forging was finished, in which the temperature was increased to the high-temperature homogenizing annealing temperature T at a rate of 25° C./h. It was calculated that the total melting temperature Tγ' of the γ' phase was 1172° C., and the annealing temperature was Tγ'+20° C.

Step 3, a bar was according to 125% of the weight of the wheel disk forging, with a height-diameter ratio of 2. The bar was upset and made into a disk blank, in which the rate of temperature increase by heating before forging was controlled to be 35° C./h, the temperature was kept at 1150° C. for 6 h, and the upsetting deformation was controlled to be 50%. After heating, the disk blank was die forged to obtain alloy wheel disk forgings, in which the rate of temperature increase by heating before forging was controlled to be 40° C./h, the temperature was kept at 1100° C. for 6 h, the die forging deformation amount was controlled to be 35%, and the die heating temperature was 350° C.

Step 4, the wheel disk forgings were subjected to machining and heat treatment including a solid solution treatment, an intermediate aging treatment and an aging treatment, in which the solid solution treatment system was 1160° C. for 8 h, the intermediate aging treatment system was 1100° C. for 7 h, and the aging treatment system was 850° C. for 32 h.

In some embodiments of this example, the starting material may be selected from one or more of metal nickel, metal chromium or nichrome, metal titanium, metal aluminum, metal molybdenum, ferroboron, metal cobalt, metal tungsten, nickel-tungsten alloys, niobium-nickel alloys, ferrovanadium, carbon electrodes and master alloys.

Example 5. A Nickel-Based Wrought Superalloy Disk Forging Having a Diameter of 900 mm for Long-Term Use at 850° C.

This example prepared nickel-based wrought superalloy disk forgings having a diameter of 900 mm for long-term use at 850° C., the alloy composition of which is shown in Example 5 in Table 1.

The preparation process of the alloy wheel disk forgings is shown in FIG. 3 and includes the following steps:

Step 1, the smelting adopted a triad process, that is, vacuum induction smelting+electroslag remelting+vacuum consumable remelting, in which the diameter of the primary alloy ingot through vacuum induction smelting was 355 mm, the diameter of the electroslag remelting alloy ingot was 423 mm, and the diameter of the alloy ingot through vacuum consumable remelting was 508 mm. The vacuum induction smelting included the following steps of: weighing raw materials according to the element proportion of the alloy, and performing vacuum induction smelting. The vacuum induction smelting process included the steps of evacuation, melting period, refining and tapping, in which the vacuum degree in the evacuating period was 20 Pa, the temperature in the melting period was controlled to be 1600° C., the temperature in the refining period was controlled to be 1500° C., the vacuum degree in the refining period was 4 Pa, the tapping temperature was controlled to be 1480° C., and 20000 Pa argon was filled for protection during tapping. After casting, cooling was carried out after finishing casting for 3 h, demoulding was performed, and the temperature was increased to a high-temperature stress relief annealing temperature T at a rate of 10° C. It was calculated that the total solution temperature Tγ' of the γ' phase was 1130° C., and the annealing temperature was Tγ'+30° C. Cooling was performed to provide the primary alloy ingot. The primary alloy ingot was machined to obtain an electroslag remelting electrode. The filling ratio of electrode to crystallizer was 0.8, and the composition of electroslag was CaF2:CaO:MgO:Al2O3:TiO2=70%:15%:1%:15%:4%, and the steady-state melting speed was 6.0 kg/min. After melting, the secondary alloy ingot was cooled for 2 h, demolded, and heated to the low-temperature stress relief annealing temperature T at the rate of 10° C./h. It was calculated that the γ' phase total solution temperature Tγ' was 1130° C., and the annealing temperature was Tγ'−250° C. A secondary alloy ingot was obtained after cooling. The electroslag remelting electrode was prepared by machining the secondary alloy ingot. With a filling ratio 0.95 of the electrode to the crystallizer and a melting speed of 5 kg/min, a tertiary alloy ingot was melted, cooled for 3 h, demoulded, and cooled to obtain the alloy ingot.

Step 2, high-temperature homogenizing annealing was performed on the alloy ingot, including the processes of heating, heat preservation and cooling, in which the rate of temperature increase was controlled to be 35° C./h, the temperature was kept at 1190° C., the temperature was kept for 50 h, and the cooling rate was controlled to be 25° C./h. After homogenizing and annealing, the alloy ingot was machined, heated to a forging temperature, kept at the temperature, and then discharged out of a furnace for forging. Before forging, the rate of temperature increase by heating was controlled to be 35° C./h, and the temperature was kept at 1170° C. for 7 h. The forging and cogging process included upsetting and drawing out. A single-fire forging time was controlled to be 1 min to 12 min, and, after the single-fire forging time exceeded 12 min, the alloy ingot was returned to the furnace for heat preservation for 3 h. Before each forging, the alloy ingot was coated with asbestos on the surface for heat preservation. The total forging ratio was controlled to be 17. After forging, the bar was subjected to the high-temperature homogenizing annealing, in which the temperature was increased to the high-temperature homogenizing annealing temperature T at a rate of 20° C./h. It was calculated that the total melting temperature Tγ' of the γ' phase was 1130° C., and the annealing temperature was Tγ'+30° C.

Step 3, a bar was cut according to 115% of the weight of the wheel disk forging, with a bar height-diameter ratio of 2. The bar was upset and made into a disk blank, in which the rate of temperature increase by heating before forging was controlled to be 40° C./h, the temperature was kept at 1120° C. for 7 h, and the upsetting deformation was controlled to be 60%. After heating, the disk blank was die forged to obtain alloy wheel disk forgings, in which the rate of temperature increase by heating before forging was controlled to be 45° C./h, the temperature was kept at 1130° C. for 3 h, the die forging deformation amount was controlled to be 60%, and the die heating temperature was 650° C.

Step 4, the wheel disk forgings were subjected to machining and heat treatment including a solid solution treatment, an intermediate aging treatment and an aging treatment, in which the solid solution treatment system was 1200° C. for 3 h, the intermediate aging treatment system was 1050° C. for 4 h, and the aging treatment system was 900° C. for 25 h.

In some embodiments of the example, the example prepared a nickel-based wrought superalloy disk forging having a diameter of 900 mm for long-term use at 850° C. and further includes impurity elements where P=0.015%, Mn=0.5%, Si=0.5%, S=0.015%, 0=0.005%, N=0.01%, Ag=0.005%, Ca=0.01%, Sn=0.01%, Pb=0.001%, Cu=0.5%, Ta=0.5% and V=0.5%.

In some embodiments of the example, the example prepared a nickel-based wrought superalloy disk forging having a diameter of 900 mm for long-term use at 850° C. and further includes impurity elements where P=0.001%, Mn=0.1%, Si=0.2%, S=0.003%, 0=0.001%, N=0.0021%, Ag=0.003%, Ca=0.0011%, Sn=0.001%, Pb=0, Cu=0, Ta=0 and V=0.

In some examples of this embodiment, the starting material may be selected from one or more of metal nickel, metal chromium or nichrome, metal titanium, metal aluminum, metal molybdenum, ferroboron, metal cobalt, metal tungsten, nickel-tungsten alloys, niobium-nickel alloys, ferrovanadium, carbon electrodes and master alloys.

Example 6. A Nickel-Based Wrought Superalloy Disk Forging Having a Diameter of 600 mm for Long-Term Use at 850° C.

This example prepared a nickel-based wrought superalloy disk forging having a diameter of 600 mm for long-term use at 850° C., the alloy composition shown in Example 6 in Table 1.

The preparation process of the alloy wheel disk forging is shown in FIG. 3 and includes the following steps:

Step 1, the smelting adopted a triad process, that is, vacuum induction smelting+electroslag remelting+vacuum consumable remelting, in which the diameter of the primary alloy ingot through vacuum induction smelting was 355 mm, the diameter of the electroslag remelting alloy ingot was 423 mm, and the diameter of the alloy ingot through vacuum consumable remelting was 508 mm. The vacuum induction smelting included the following steps of: weighing raw materials according to the element proportion of the alloy, and performing vacuum induction smelting. The vacuum induction smelting process included the steps of evacuation, melting period, refining and tapping, in which the vacuum degree in the evacuating period was 30 Pa, the temperature in the melting period was controlled to be 1580° C., the temperature in the refining period was controlled to be 1550° C., the vacuum degree in the refining period was 5 Pa, the tapping temperature was controlled to be 1400° C., and 30000 Pa argon was filled for protection during tapping. After casting, cooling was carried out after finishing casting for 3 h, demoulding was performed, and the temperature was increased to a high-temperature stress relief annealing temperature T at a rate of 25° C. It was calculated that the total solution temperature Tγ' of the γ' phase is 1178° C., and the annealing temperature is Tγ'−30° C. Cooling was performed to obtain the primary alloy ingot. The primary alloy ingot was machined to obtain an electroslag remelting electrode. The filling ratio of electrode to crystallizer was 0.75, and the composition of electroslag was CaF2:CaO:MgO:$Al_2O3$:TiO2=68%:14%:2%:14%:2%, the steady-state melting speed was 5.0 kg/min. After melting, the secondary alloy ingot was cooled for 6 h, demolded, and heated to the low-temperature stress relief annealing temperature T at the rate of 50° C./h. It was calculated that γ' phase total solution temperature Tγ' was 1178° C. and the annealing temperature was Tγ'−100° C. A secondary alloy ingot was obtained after cooling. The electroslag remelting electrode was prepared by machining the secondary alloy ingot. With a filling ratio 0.87 of the electrode to the crystallizer and a melting speed of 3.8 kg/min, a tertiary alloy ingot was melted, cooled for 2 h, demoulded and cooled to obtain the alloy ingot.

Step 2, high-temperature homogenizing annealing was performed on the alloy ingot, including the processes of heating, heat preservation and cooling, in which the rate of temperature increase was controlled to be 15° C./h, the temperature was kept at 1170° C., the temperature was kept for 70 h, and the cooling rate was controlled to be 10° C./h. After homogenizing and annealing, the alloy ingot was machined, heated to a forging temperature, kept at the temperature, and then discharged out of a furnace for forging. Before forging, the rate of temperature increase by heating was controlled to be 30° C./h, the temperature was kept at 1090° C. for 5 h. The forging and cogging process included upsetting and drawing out. A single-fire forging time was controlled to be 1 min to 12 min, and, after the single-fire forging time exceeded 12 min, the alloy ingot was returned to the furnace for heat preservation for 3 h, Before each forging, the alloy ingot was coated with asbestos on the surface for heat preservation. The total forging ratio was controlled to be 8. After forging, the bar was subjected to the high-temperature homogenizing annealing, in which the temperature was increased to the high-temperature homogenizing annealing temperature T at a rate of 10° C./h. It was calculated that the total melting temperature Tγ' of the γ' phase was 1178° C., and the annealing temperature was Tγ'−30° C.

Step 3, a bar was cut according to 145% of the weight of the wheel disk forging, with a bar height-diameter ratio of 2.5, The bar was heated, upset and made into a disk blank, in which the rate of temperature increase by heating before forging was controlled to be 35° C./h. the temperature was kept at 1150° C. for 4 h, and the upsetting deformation was controlled to be 50%. After heating, the disk blank was die forged to obtain alloy wheel disk forgings, in which the rate of temperature increase by heating before forging was controlled to be 35° C./h, the temperature was kept at 1100° C. for 4 h, the die forging deformation amount was 35%, and the die heating temperature was 350° C.

Step 4, the wheel disk forgings were subjected to machining and heat treatment including a solid solution treatment, an intermediate aging treatment and an aging treatment, in which the solid solution treatment system was 1160° C. for 8 h, the intermediate aging treatment system was 1100° C. for 10 h, and the aging treatment system was 850° C. for 30 h.

In the example, a nickel-based wrought superalloy disk forging having a diameter of 600 mm for long-term use at 850° C. as prepared further includes impurity elements where P=0.010%, Mn=0.15%, Si=0.15%, S=0.005%, 0=0.002%, N=0.005%, Ag=0.0005%, Ca=0.005%, Sn=0.005%, Pb=0.0005%, Cu=0.1%, Ta=0.1% and V=0.1%.

In the example, a nickel-based wrought superalloy disk forging having a diameter of 600 mm for long-term use at 850° C. as prepared further includes impurity elements where P=0.010%, Mn=0.102%, Si=0.10%, S=0.001%, 0=0.001%, N=0.00015%, Ag=0.0001%, Ca=0.0015%, Sn=0, Pb=0.0, Cu=0.01%, Ta=0.01% and V=0.02%.

In some examples of this embodiment, the starting material may be selected from one or more of metal nickel, metal chromium or nichrome, metal titanium, metal aluminum, metal molybdenum, ferroboron, metal cobalt, metal tungsten, nickel-tungsten alloys, niobium-nickel alloys, ferrovanadium, carbon electrodes and master alloys.

Example 7. A Nickel-Based Wrought Superalloy Disk Forging Having a Diameter of 600 mm for Long-Term Use at 850° C.

This example prepared a nickel-based wrought superalloy disk forging having a diameter of 600 mm for long-term use at 850° C., the alloy composition of which is shown in Example 6 in Table 1.

The difference from Example 6 is: in Step 1 of the preparation process of the alloy wheel disk forging, the primary alloy ingot was an alloy ingot with a diameter less than 500 mm, the process of the primary alloy ingot was changed to: directly performing vacuum consumable remelting on the primary alloy ingot to obtain the alloy ingot.

The other process was the same as in Example 6.

In some embodiments of the example, the example prepared a nickel-based wrought superalloy disk forging having a diameter of 600 mm for long-term use at 850° C. which further included impurity elements where P=0.015%, Mn=0.5%, Si=0.5%, S=0.015%, 0=0.005%, N=0.01%, Ag=0.005%, Ca=0.01%, Sn=0.01%, Pb=0.001%, Cu=0.5%, Ta=0.5% and V=0.5%.

In some embodiments of the example, the example prepared a nickel-based wrought superalloy disk forging having a diameter of 600 mm for long-term use at 850° C. which further included impurity elements where P=0.001%, Mn=0.1%, Si=0.2%, S=0.003%, 0=0.001%, N=0.0021%, Ag=0.003%, Ca=0.0011%, Sn=0.001%, Pb=0, Cu=0, Ta=0 and V=0.

Example 8. A Nickel-Based Wrought Superalloy Disk Forging Having a Diameter of 600 mm for Long-Term Use at 850° C.

This example prepared a nickel-based wrought superalloy disk forging having a diameter of 600 mm for long-term use at 850° C., the alloy composition of which is shown in Example 1 in Table 1.

The difference from Example 1 is: in Step 1 of the preparation process of the alloy wheel disk forging, the primary alloy ingot was an alloy ingot with the diameter less than 500 mm, the process of the primary alloy ingot was changed to: directly performing vacuum consumable remelting on the primary alloy ingot to obtain the alloy ingot.

The other process is the same as in Example 1.

In some embodiments of the example, the example prepared a nickel-based wrought superalloy disk forging having a diameter of 600 mm for long-term use at 850° C. which further included impurity elements where P=0.015%, Mn=0.5%, Si=0.5%, S=0.015%, 0=0.005%, N=0.01%, Ag=0.005%, Ca=0.01%, Sn=0.01%, Pb=0.001%, Cu=0.5%, Ta=0.5% and V=0.5%.

In some embodiments of the example, the example prepared a nickel-based wrought superalloy disk forging having a diameter of 600 mm for long-term use at 850° C. which further included impurity elements where P=0.001%, Mn=0.1%, Si=0.2%, S=0.003%, 0=0.001%, N=0.0021%, Ag=0.003%, Ca=0.0011%, Sn=0.001%, Pb=0, Cu=0, Ta=0 and V=0.

Example 9. A Nickel-Based Wrought Superalloy Disk Forging Having a Diameter of 600 mm for Long-Term Use at 850° C.

This example prepared a nickel-based wrought superalloy disk forging having a diameter of 600 mm for long-term use at 850° C., the alloy composition of which is shown in Example 2 in Table 1.

The difference from Example 2 is: in Step 1 of the preparation process of the alloy wheel disk forging, the primary alloy ingot is an alloy ingot with the diameter less than 500 mm, the process of the primary alloy ingot was changed to: directly performing vacuum consumable remelting on the primary alloy ingot to obtain the alloy ingot.

The other process was the same as in Example 2.

In some embodiments of the example, the example prepared a nickel-based wrought superalloy disk forging having a diameter of 600 mm for long-term use at 850° C. which further included impurity elements where P=0.015%, Mn=0.5%, Si=0.5%, S=0.015%, 0=0.005%, N=0.01%, Ag=0.005%, Ca=0.01%, Sn=0.01%, Pb=0.001%, Cu=0.5%, Ta=0.5% and V=0.5%.

In some embodiments of the example, the example prepared a nickel-based wrought superalloy disk forging having a diameter of 600 mm for long-term use at 850° C. which further included impurity elements where P=0.001%, Mn=0.1%, Si=0.2%, S=0.003%, 0=0.001%, N=0.0021%, Ag=0.003%, Ca=0.0011%, Sn=0.001%, Pb=0, Cu=0, Ta=0 and V=0.

Example 10. A Nickel-Based Wrought Superalloy Disk Forging Having a Diameter of 600 mm for Long-Term Use at 850° C.

This example prepared a nickel-based wrought superalloy disk forging having a diameter of 600 mm for long-term use at 850° C., the alloy composition shown in Example 3 in Table 1.

The difference from Example 3 is: in Step 1 of the preparation process of the alloy wheel disk forging, the primary alloy ingot is an alloy ingot with the diameter less than 500 mm, the process of the primary alloy ingot was changed to: directly performing vacuum consumable remelting on the primary alloy ingot to obtain the alloy ingot.

The other process was the same as in Example 3.

In some embodiments of the example, the example prepared a nickel-based wrought superalloy disk forging having a diameter of 600 mm for long-term use at 850° C. which further included impurity elements where P=0.015%, Mn=0.5%, Si=0.5%, S=0.015%, 0=0.005%, N=0.01%, Ag=0.005%, Ca=0.01%, Sn=0.01%, Pb=0.001%, Cu=0.5%, Ta=0.5% and V=0.5%.

In some embodiments of the example, the example prepared a nickel-based wrought superalloy disk forging having a diameter of 600 mm for long-term use at 850° C. which further included impurity elements where P=0.001%, Mn=0.1%, Si=0.2%, S=0.003%, 0=0.001%, N=0.0021%, Ag=0.003%, Ca=0.0011%, Sn=0.001%, Pb=0, Cu=0, Ta=0 and V=0.

Example 11. A Nickel-Based Wrought Superalloy Disk Forging Having a Diameter of 600 mm for Long-Term Use at 850° C.

This example prepared a nickel-based wrought superalloy disk forging having a diameter of 600 mm for long-term use at 850° C., the alloy composition of which is shown in Example 4 in Table 1.

The difference from Example 4 is: in Step 1 of the preparation process of the alloy wheel disk forging, the primary alloy ingot was an alloy ingot with the diameter less than 500 mm, the process of the primary alloy ingot was changed to: directly performing vacuum consumable remelting on the primary alloy ingot to obtain the alloy ingot.

The other process was the same as in Example 4.

In some embodiments of the example, the example prepared a nickel-based wrought superalloy disk forging having a diameter of 600 mm for long-term use at 850° C. which further included impurity elements where P=0.015%, Mn=0.5%, Si=0.5%, S=0.015%, 0=0.005%, N=0.01%, Ag=0.005%, Ca=0.01%, Sn=0.01%, Pb=0.001%, Cu=0.5%, Ta=0.5% and V=0.5%.

In some embodiments of the example, the example prepared a nickel-based wrought superalloy disk forging having a diameter of 600 mm for long-term use at 850° C. which further included impurity elements where P=0.001%, Mn=0.1%, Si=0.2%, S=0.003%, 0=0.001%, N=0.0021%, Ag=0.003%, Ca=0.0011%, Sn=0.001%, Pb=0, Cu=0, Ta=0 and V=0.

Example 12. A Nickel-Based Wrought Superalloy Disk Forging Having a Diameter of 600 mm for Long-Term Use at 850° C.

This example prepared a nickel-based wrought superalloy disk forging having a diameter of 600 mm for long-term use at 850° C., the alloy composition of which is shown in Example 5 in Table 1.

The difference from Example 5 is: in Step 1 of the preparation process of the alloy wheel disk forging, the primary alloy ingot was an alloy ingot with the diameter less than 500 mm, the process of the primary alloy ingot was changed to: directly performing vacuum consumable remelting on the primary alloy ingot to obtain the alloy ingot.

The other process was the same as in Example 5.

In some embodiments of the example, the example prepared a nickel-based wrought superalloy disk forging having a diameter of 600 mm for long-term use at 850° C. which further included impurity elements where P=0.015%, Mn=0.5%, Si=0.5%, S=0.015%, 0=0.005%, N=0.01%, Ag=0.005%, Ca=0.01%, Sn=0.01%, Pb=0.001%, Cu=0.5%, Ta=0.5% and V=0.5%.

In some embodiments of the example, the example prepared a nickel-based wrought superalloy disk forging having a diameter of 600 mm for long-term use at 850° C. which further included impurity elements where P=0.001%, Mn=0.1%, Si=0.2%, S=0.003%, 0=0.001%, N=0.0021%, Ag=0.003%, Ca=0.0011%, Sn=0.001%, Pb=0, Cu=0, Ta=0 and V=0.

Example 13. Performance Measurement Experiment

A nickel-based wrought superalloy for use above 850° C. obtained from any one of Examples 1 to 12 was examined and analyzed by the inventors to find that the nickel-based wrought superalloy was composed of Ni—Co—Cr as a matrix component to form a stable γ austenite matrix, and a coherent precipitated γ' phase as a main strengthening phase, a high content of γ' phase forming elements Al, Ti, Nb was added, wherein the mass percentage content of the γ' phase was up to 55-65%, a high content of W and Mo elements was used for solid solution strengthening, a proper amount of B, Zr, Ce and Mg were added for micro-alloying to improve the grain boundary performance, MC type, M6C type and M23C6 type carbides precipitate in the alloy, and the second phases such as MB2, M3B2 type borides were compounded and strengthened. The part of the technical effect of the nickel-based wrought superalloy obtained in Example 1 is the same as that of the nickel-based wrought superalloy obtained in the other examples, as shown in FIG. 1.

Refer to GB/T228.2 Metallic material tensile test Part 2. High temperature test method for testing. The results show that under 850° C. conditions, the tensile strength and yield strength of the alloy obtained from any one of Examples 1 to 12 can reach over 850 MPa and over 700 MPa. Refer to GB/T2039 metal tensile creep and endurance test method, the results show that the alloy obtained from any one of Examples 1 to 12 has an endurance life of more than 100 h under 350 MPa.

The nickel-based wrought superalloy obtained from any one of Examples 1 to 12 has been subjected to long-term aging for more than 5000 h at a temperature range of 650-900° C. at room temperature and the content of precipitated harmful phase μ phase does not exceed 1%. The part of the technical effect of the nickel-based wrought superalloy obtained in Example 1 is as shown in FIG. 2, the part of the technical effect of the nickel-based wrought superalloy obtained in other embodiments is similar. In summary, it can be seen that the alloy obtained by the present application can be used as a wheel disk material for long-term use at 850° C.

The nickel-based wrought superalloy obtained from any one of Examples 1 to 12, which has a chemical composition of (Ni, Co) 3 (Al, Ti, Nb) as a main strengthening phase γ' and the γ' phase containing a certain amount of Nb element is more stable during hot processing. The precipitation speed of γ' phase is slow in the process of forging and cogging under the free forging condition, so that the problem of thermoplastic degradation of the steel ingot caused by strain aging precipitation is avoided, the alloy has sufficient thermoplastic property, and free forging cogging can be realized.

The nickel-based wrought superalloy obtained in any one of Examples 1 to 12 was determined by phase analysis using the electrolytic extraction method. It is based on γ austenite as the matrix, and the mass percentage content of the strengthened phase γ' phase reaches 55-65%. The present inventor has found that the composition of the alloy determines the precipitable content of the strengthening phase γ' phase, and 55-65% of the γ' phase can be precipitated in the alloy after heat treatment including solution treatment, intermediate aging treatment and aging treatment.

The nickel-based wrought superalloy obtained in any one of Examples 1 to 12 can be used for preparing a wheel disk forging with the diameter of 100-1200 mm by adopting the smelting, forging cogging, forging forming and heat processes provided by the invention, industrial production can be realized by adopting existing conventional equipment, and the nickel-based wrought superalloy has good casting-forging process performance.

In summary, the nickel-based wrought superalloy wheel disk material for long-term use at 850-900° C. obtained by any one of the examples 1 to 12 of the present application can be used to prepare a wheel disk forging with a diameter of 100-1200 mm by a reasonable composition design and preparation method, which has excellent tensile and durability properties under 850° C. conditions, and has good long-term structure stability, and moreover, has the capability of industrial batch production.

Comparative Example 1. A Nickel-Based Wrought Superalloy Disk Forging Having a Diameter of 900 mm for Long-Term Use at 850° C.

The comparative example prepared a nickel-based wrought superalloy disk forging having a diameter of 900 mm for long-term use at 850° C., the alloy composition of which is shown in Comparative Example 1 in Table 1, and compared with other examples, the content of trace elements such as B, Zr, Ce, Mg and the like is lower.

The preparation process of the alloy wheel disk forging is as follows:

the smelting adopted a duplex process, that is, vacuum induction smelting+vacuum consumable remelting, in which the diameter of the primary alloy ingot through vacuum induction smelting was 355 mm, the diameter of the electroslag remelting alloy ingot was 440 mm, and the diameter of the alloy ingot through vacuum consumable remelting was 508 mm. The vacuum induction smelting included the following steps of: weighing raw materials according to the element ratio of the alloy, wherein the metal raw materials included: metal nickel, metal chromium or nickel-chromium alloy, metal titanium, metal aluminum, metal molybdenum, ferroboron, metal cobalt, metal tungsten, nickel-tungsten alloy, niobium-nickel alloy, ferrovanadium, carbon electrode, return material and the like. The vacuum induction smelting process included the steps of evacuating period, melting period, refining, tapping and the like, wherein the vacuum degree in the evacuating period was 20 Pa, the temperature in the melting period was controlled to be 1550° C., the temperature in the refining period was controlled to be 1500° C., the vacuum degree in the refining period was 4 Pa, the tapping temperature was controlled to be 1480° C., and the tapping was filled with 20000 Pa argon protection. After casting, a primary alloy ingot was obtained by cooling for 3 h, demoulding, and cooling. The consumable remelting electrode was prepared by machining the primary alloy ingot. The filling ratio of the electrode to the crystallizer was 0.85, the melting speed was 3.5 kg/min, the cooling time was 2 h after the tertiary alloy ingot was melted, and then the ingot was demoulded and cooled to obtain the alloy ingot.

High-temperature homogenizing annealing was performed on the alloy ingot, including the processes of heating, heat preservation and cooling, wherein the rate of temperature increase was controlled to be 35° C./h, the temperature was kept at 1190° C. for 50 h, and the cooling rate was controlled to be 25° C./h. After homogenizing and annealing, the alloy ingot was machined, heated to a forging temperature, kept at the temperature, and then discharged out of a furnace for forging. Before forging, the rate of temperature increase by heating was controlled to be 35° C./h, the temperature was kept at 1170° C. for 6 h, wherein the forging and cogging process included upsetting and drawing out. After a single-fire forging time exceeded 15 min, the alloy ingot was returned to the furnace for heat preservation for 2 h. Before each forging, the alloy ingot was coated with asbestos on the surface for heat preservation. The total forging ratio was controlled to be 15. After forging, the bar was subjected to the high-temperature homogenizing annealing, in which the temperature was increased to the high-temperature homogenizing annealing temperature T at a rate of 30° C./h. It was calculated that the total melting temperature Tγ' of the γ' phase was 1139° C., and the annealing temperature was Tγ'−20° C.

A bar was cut with an appropriate length according to the weight of the wheel disk forging, with a bar height-diameter ratio of 2.5, heated, upset and made into blank. Before forging, the rate of temperature increase by heating was controlled to be 35° C./h, the temperature was kept at 1120° C. for 4 h, and the upsetting deformation was controlled to be 40% to obtain the disk blank. After heating, the disk blank was die forged to obtain alloy wheel disk forgings, in which the rate of temperature increase by heating before forging was controlled to be 35° C./h, the temperature was kept at 1120° C. for 4 h, the die forging deformation amount was 40%, and the die heating temperature was 650° C.

The wheel disk forgings were subjected to machining and heat treatment including a solid solution treatment, an intermediate aging treatment and an aging treatment, in which the solid solution treatment system was 1180° C. for 5 h, the intermediate aging treatment system was 1050° C. for 4 h, and the aging treatment system was 910° C. for 12 h.

With regard to the alloy bar prepared in Comparative Example 1, the ingot has a melting speed fluctuation in the process of electroslag remelting and vacuum consumable remelting, a black spot metallurgical defect is found by low-power inspection, cracking is obvious in the process of forging and cogging, and the cracking tendency is greater than that of Example 3.

Comparative Example 2. A Nickel-Based Wrought Superalloy Disk Forging Having a Diameter of 900 mm for Long-Term Use at 850° C.

The comparative example produces a nickel-based wrought superalloy disk forging having a diameter of 900 mm for long-term use at 850° C., the alloy composition of which is shown in Comparative Example 2 in Table 1, and compared with other examples, the Mo content was increased, the W content was decreased, and the Fe content was increased.

The preparation process of the alloy wheel disk forging is as follows:

the smelting adopted a duplex process, that is, vacuum induction smelting+electroslag remelting+vacuum consumable remelting, in which the diameter of the primary alloy ingot through vacuum induction smelting was 355 mm, the diameter of the electroslag remelting alloy ingot was 423 mm, and the diameter of the alloy ingot through vacuum consumable remelting was 508 mm. The vacuum induction smelting included the following steps of: weighing raw materials according to the element ratio of the alloy, in which the metal raw materials included: metal nickel, metal chromium or nickel-chromium alloy, metal titanium, metal aluminum, metal molybdenum, ferroboron, metal cobalt, metal tungsten, nickel-tungsten alloy, niobium-nickel alloy, ferrovanadium, carbon electrode, return material and the like. The vacuum induction smelting process included the steps of evacuation, melting period, refining and tapping, wherein the vacuum degree in the evacuating period was 20 Pa, the temperature in the melting period was controlled to be 1550° C., the temperature in the refining period was controlled to be 1500° C., the vacuum degree in the refining period was 4 Pa, the tapping temperature was controlled to be 1480° C., and 20,000 Pa argon was filled for protection during tapping. After casting, cooling was carried out for 3 h, demoulding was performed, and the temperature was increased to a high-temperature stress relief annealing temperature T at a rate of 35° C. It was calculated that the total solution temperature Tγ' of the γ' phase was 1129° C., the annealing temperature was Tγ'+30° C., and cooling was performed to obtain the primary alloy ingot. The primary alloy ingot was machined to obtain an electroslag remelting electrode. The filling ratio of electrode to crystallizer was 0.8, and the composition of electroslag was CaF2:CaO:MgO:Al2O3:TiO2=65%:15%:1%:15%:4%, the steady-state melting speed was 5.0 kg/min. After melting, the secondary alloy ingot was cooled for 2 h, demolded, and heated to the low-temperature stress relief annealing temperature T at the rate of 45° C./h. It was calculated that γ' phase total solution temperature Tγ' was 1129° C., and the annealing temperature was Tγ'−200° C. A secondary alloy ingot was obtained after cooling. The electroslag remelting electrode was prepared by machining the secondary alloy ingot. With a filling ratio 0.83 of the electrode to the crystallizer and a melting speed of 2.8 kg/min, the tertiary alloy ingot was melted, and then cooled for 2 h, and then the ingot was demoulded and cooled to obtain the alloy ingot.

High-temperature homogenizing annealing was performed on the alloy ingot, including the processes of heating, heat preservation and cooling, in which the rate of temperature increase was controlled to be 35° C./h, the temperature was kept at 1190° C. for 50 h, and the cooling rate was controlled to be 25° C./h. After homogenizing and annealing, the alloy ingot was machined, heated to a forging temperature, kept at the temperature, and then discharged out of a furnace for forging. Before forging, the rate of temperature increase by heating was controlled to be 35° C./h, the temperature was kept at 1170° C. for 6 h, wherein the forging and cogging process included upsetting and drawing out. After a single-fire forging time exceeded 15 min, the alloy ingot was returned to the furnace for heat preservation for 2 h. Before each forging, the alloy ingot was coated with asbestos on the surface for heat preservation. The total forging ratio was controlled to be 15.

A bar was cut with an appropriate length according to the weight of the wheel disk forging, with a bar height-diameter ratio of 2.5, The bar was upset and made into a disk blank, in which the rate of temperature increase by heating before forging was controlled to be 35° C./the temperature was kept at 1120° C. for 4 h, and the upsetting deformation was controlled to be 40% to obtain the disk blank. After heating, the disk blank was die forged to obtain alloy wheel disk forgings, in which the rate of temperature increase by heating before forging was controlled to be 35° C./h, the temperature was kept at 1120° C., the temperature was kept for 4 h, the die forging deformation amount was 40%, and the die heating temperature was 650° C.

the wheel disk forgings were subjected to machining and heat treatment including a solid solution treatment, an intermediate aging treatment and an aging treatment, in which the solid solution treatment system was 1180° C. for 5 h, the intermediate aging treatment system was 1050° C. for 4 h, and the aging treatment system was 910° C. for 12 h.

The alloy wheel disk forging prepared in the comparative example 2 is taken as a sample, and the structure analysis showed that more coarse grains of ASTM 00 grade exist, the mixed crystal problem is more prominent, the high-temperature long-time structure stability test is carried out, after 850° C. long-time aging is carried out for 3000 h, more harmful phase σ phase and μ phase are precipitated, and the 850° C. long-time structure stability is poor.

Although only the preferred embodiment of the present application has been described above, the scope of the present application is not limited thereto, and any changes or substitutions that may be readily made by those skilled in the art within the scope of the present disclosure are intended to be within the scope of the present application.

What is claimed is:

1. A preparation method of nickel-based wrought superalloy wheel disk forgings, comprising following steps:

Step 1: weighing raw materials according to a composition proportion wherein the raw materials comprise by weight percentage: C: 0.01~0.08%, W: 6.5~8.0%, Cr: 7.5~11.0%, Mo: 1.5~3.5%, Co: 14.5~17.5%, Ti: 1.0~2.0%, Al: 4.0~5.5%, Nb: 1.0~2.0%, Zr: 0.005~0.05%, Mg: 0.005~0.05%; Ce: 0.001~0.05%, B: 0.005~0.05% and Fe: 0.01~1.5%, and balance of Ni; and the raw materials further comprise impurity elements: P≤0.015%, Mn≤0.5%, Si≤0.5%, S≤0.015%, O≤0.005%, N≤0.01%, Ag≤0.005%, Ca≤0.01%, Sn≤0.01%, Pb≤0.001%, Cu≤0.5%, Ta≤0.5% and V≤0.5%;

step 2: smelting the raw materials into a primary alloy ingot by vacuum induction smelting comprising the following steps of: evacuating, smelting, refining and tapping, demoulding, subjecting the primary alloy ingot to high-temperature stress relief annealing and electroslag remelting refining to obtain a secondary alloy ingot, demoulding, subjecting the secondary alloy ingot to low-temperature stress relief annealing and vacuum consumable remelting refining to obtain a tertiary alloy ingot, thereby obtaining an alloy ingot; in the evacuating process, the vacuum degree is 10-100 Pa; in the process of the smelting stage, the temperature is controlled to be 1300° C.-1650° C.; in the refining process, the temperature is controlled to be 1400° C.-1600° C., and the vacuum degree is 1-20 Pa; in the tapping process, the temperature is controlled to be 1420° C.-1590° C., and 10,000-50,000 Pa argon gas is filled for protection; after casting, cooling is performed for 0.5-3 h, and demoulding is performed to obtain a primary alloy ingot; and the primary alloy ingot is subjected to high-temperature stress relief annealing treatment, wherein the temperature is increased to a high-temperature stress relief annealing temperature T at a rate of 10-50° C./h, the temperature of T is the total melting temperature of γ' phase Tγ'±50° C., and Tγ' is calculated from the measured composition of the alloy using the commercial software Jmatpro; wherein the temperature is increased to a low-temperature stress relief annealing temperature T at a rate of 10-50° C./h, the temperature of T is Tγ'−100 to Tγ'−250° C., and Tγ' is calculated from the measured composition of the alloy using the commercial software Jmatpro;

step 3: performing a first high-temperature homogenizing annealing on the alloy ingot obtained in Step 2 to obtain a high-temperature homogenizing annealed alloy, wherein the first high-temperature homogenizing annealing comprises heating, heat preservation and cooling processes, the heating rate is controlled to be 15-60° C./h, the temperature of the heat preservation is 1150-1250° C., and the time of the heat preservation is 24-72 h; and the cooling rate is controlled to be 5-55° C./h; and performing heating, forging and cogging on the alloy to obtain a bar, and subjecting the bar to a second high-temperature homogenizing annealing to obtain wheel disk forgings; wherein the temperature is increased to the second high-temperature homogenizing annealing temperature T at a rate of 10-50° C./h, and the temperature of T is Tγ'±30° C., Tγ' is calculated from the measured composition of the alloy using the commercial software Jmatpro;

step 4: cutting the bar obtained in Step 3 according to the weight of the wheel disk forgings to obtain a cut bar, and subjecting the cut bar to blank making and die forging to obtain an alloy wheel disk forging, wherein the weight of the cut bar is 115-145% of the weight of the wheel disk forging, the height-diameter ratio of the cut bar is controlled to be 1.5-3.0; and step 5: performing heat treatment on the alloy wheel disk forgings obtained in Step 4 to obtain nickel-based wrought superalloy wheel disk forgings, wherein the heat treatment comprises a solid solution treatment, an intermediate aging treatment and an aging treatment, the solid solution treatment method comprises performing heat preservation at 1150-1220° C. for 2-10 h, the intermediate aging treatment method comprises performing heat preservation at 1000-1150° C. for 2-10 h; and the aging treatment method comprises performing heat preservation at 760° C.-920° C. for 8-32 h.

2. The preparation method of claim 1, further comprising: preparing the primary alloy ingot into an electroslag remelting electrode, wherein the filling ratio of the electroslag remelting electrode to the crystallizer is 0.75-0.9; the composition ratio of the adopted electroslag in the electroslag remelting process is $CaF_2$:CaO:MgO:$Al_2O_3$: $TiO_2$=65-75%: 10-20%: 0.5-5%: 10-20%: 0.5-5%, the steady-state melting speed is 1.0-6.0 kg/min, and the cooling time of the secondary alloy ingot after the electroslag remelting refining is 0.5 h-6 h; demoulding to obtain the secondary alloy ingot; and subjecting the secondary alloy ingot to low-temperature stress relief annealing.

3. The preparation method of claim 1, wherein Step 2 further comprises: preparing the secondary alloy ingot into a consumable remelting electrode, wherein the filling ratio of the consumable remelting electrode to the crystallizer is 0.75-0.95, and the melting speed is 1.0-5.0 kg/min; and, after finishing the vacuum consumable remelting refining, cooling the tertiary alloy ingot for 0.5 h-3 h, then demoulding, and cooling.

4. The preparation method of claim 1, wherein Step 3 further comprises: after the first high-temperature homogenizing annealing, heating the alloy ingot obtained in Step 2 to a forging temperature, keeping the temperature, discharging from a furnace, and forging and cogging to obtain a bar, wherein the rate of temperature increase by heating before forging is controlled to be 15-60° C./h, the temperature is kept at 1050° C.-1180° C. for 2-8 h, the forging and cogging process comprises upsetting and drawing out, heat preservation in a furnace is performed for 1-6 h after a single-fire forging time exceeds 5 min, asbestos is coated on the surface of the alloy ingot before each forging for heat preservation, and the total forging ratio is controlled to be 5-20; and subjecting the bar to the second high-temperature homogenizing annealing after forging.

5. The preparation method of claim 1, wherein Step 4 further comprises: heating the cut bar, upsetting and making blank to obtain a disk blank, wherein the rate of temperature increase by heating before forging is controlled to be 20-50° C./h, the temperature is kept at 1000° C.-1150° C. for 2-8 h, and the upsetting deformation is 30-70%.

6. The preparation method of claim 5, wherein the disk blank is subjected to die forging after being heated, wherein the rate of temperature increase by heating before forging is controlled to be 20-50° C./h, the temperature is kept at 950° C.-1150° C. for 2-8 h, the die forging deformation is 30-70%, and the die heating temperature is 300-1050° C.

* * * * *